US006322325B1

(12) United States Patent
Belehradek

(10) Patent No.: US 6,322,325 B1
(45) Date of Patent: Nov. 27, 2001

(54) PROCESSOR BASED PUMP CONTROL SYSTEMS

(75) Inventor: Anton Belehradek, Downers Grove, IL (US)

(73) Assignee: Metropolitan Industries, Inc., Romeoville, IL (US)

( * ) Notice: Subject to any disclaimer, the term of this patent is extended or adjusted under 35 U.S.C. 154(b) by 0 days.

(21) Appl. No.: 09/231,124

(22) Filed: Jan. 15, 1999

(51) Int. Cl.[7] ..... F04B 41/06
(52) U.S. Cl. ..... 417/2; 417/40; 417/44.11
(58) Field of Search ..... 417/63, 2, 36, 417/40, 44.11

(56) References Cited

U.S. PATENT DOCUMENTS 3,824,852 * 7/1974 Otto ..... 73/170 A
3,908,441 * 9/1975 Virloget ..... 73/55
4,119,860 * 10/1978 Gooley ..... 250/577
4,202,036 * 5/1980 Bowdith et al. ..... 364/420
4,437,811 * 3/1984 Iwata et al. ..... 417/36
4,598,742 * 7/1986 Taylor ..... 141/95
4,652,802 * 3/1987 Johnston ..... 218/482
4,792,660 * 12/1988 Cooley et al. ..... 219/295
4,904,878 * 2/1990 Gipp et al. ..... 250/577
4,945,491 * 7/1990 Rishel ..... 364/510
5,159,318 * 10/1992 Kronberg ..... 340/622
5,449,274 9/1995 Kochan, Jr. .
5,503,533 * 4/1996 Potter et al. ..... 417/63
5,742,500 * 4/1998 Irvin ..... 417/2
5,747,824 * 5/1998 Jung et al. ..... 250/577

OTHER PUBLICATIONS

General Signal Pump Group, a Unit of General Signal, Hydromatic™ "Pump+ " (May, 1995).

* cited by examiner

*Primary Examiner*—Cheryl J. Tyler
(74) *Attorney, Agent, or Firm*—Rockey, Milnamow & Katz, Ltd.

(57) ABSTRACT

A pump control system incorporates a programmed processor and responds to input from multiple floats. The programmed processor can respond to detected float failures in real time by reassigning control, lag, or lead functions from a failing float to one of the remaining functioning floats. Pump alternating functionality can be provided if any two of a plurality of four or more floats continue to function as expected.

8 Claims, 36 Drawing Sheets

PROCESSOR BASED PUMP CONTROL SYSTEMS

FIELD OF THE INVENTION

The invention pertains to pump control systems. More particularly, the invention pertains to such control systems, which include processors programmed to reconfigure the inputs in response to faults detected therein.

BACKGROUND OF THE INVENTION

There are numerous applications where it is desirable to use two or more pumps on a cyclical basis for maintaining the level of fluid in a sump or a tank. The use of multiple pumps increases overall system reliability and extends the time period during which any one pump may be kept in service.

Prior products are known for the purpose of cyclically energizing the members of a group of pumps. One known product incorporates hardwired pump alternator circuitry in combination with two pumps for maintaining the level of fluid in a sump or a tank. A float or a pressure switch is often associated with each pump. The float or pressure switch of each pump provides feedback so as to determine when to energize a selected pump. At times, the feedback is also used to determine when to terminate energizing of that pump.

Some of the known pump alternator systems use current sensors in the feedback path to determine when a pump should be energized. Such sensors tend to be more expensive than desired in many types of products. In addition, known systems physically associate a float switch or a pressure switch with a particular pump. There is usually no circuitry to permit reallocation of float switches or pressure switches among available pumps.

There thus continues to be a need for cost effective, reliable pump alternator systems. Preferably, such systems would incorporate relatively inexpensive feedback elements and could be expandable to more than two pumps. Also, it would be preferred if feedback sensors could be dynamically reallocated in response to a sensed failure.

SUMMARY OF THE INVENTION

A software driven pump control system includes a processor programmed with control instructions that respond to a plurality of fluid level inputs. Processor outputs control the operation of a plurality of pumps.

In one aspect, a pump control system can be implemented with a plurality of pumps whose functions such as lead pump, lag pump can be reassigned by the control program to extend pump life. Level indicating signals from a plurality of float or pressure switches provide a basis for energizing and de-energizing the pumps.

In a pump alternator system, two pumps can be controlled with, for example, four fluid related feedback inputs. The pumps can be alternately energized. Alternately, lead and lag functions can be assigned and reassigned based on running time, elapsed time or the like.

The feedback signals can be generated by float switches, pressure switches or the like without limitation. Pump drive characteristics can, if necessary, be taken into account in the control instructions.

Feedback switch fault conditions can be detected and functions such as lead, lag, control and high level can be reassigned dynamically in real time. In such instances, the system will function substantially normally in the absence of one or more normally expected inputs. Two different feedback signals can fail and the associated functions reassigned.

In yet another aspect, a standardized pump control module includes a processor with associated control instructions. The instructions can be stored in rewriteable read only memory, EEPROM.

Input connectors, coupled via input interface circuitry to the processor, can be coupled to a plurality of fluid related sources such as float or pressure switches. Output connectors, coupled via output interface circuitry to the processor, can be coupled to a plurality of pumps.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1A:
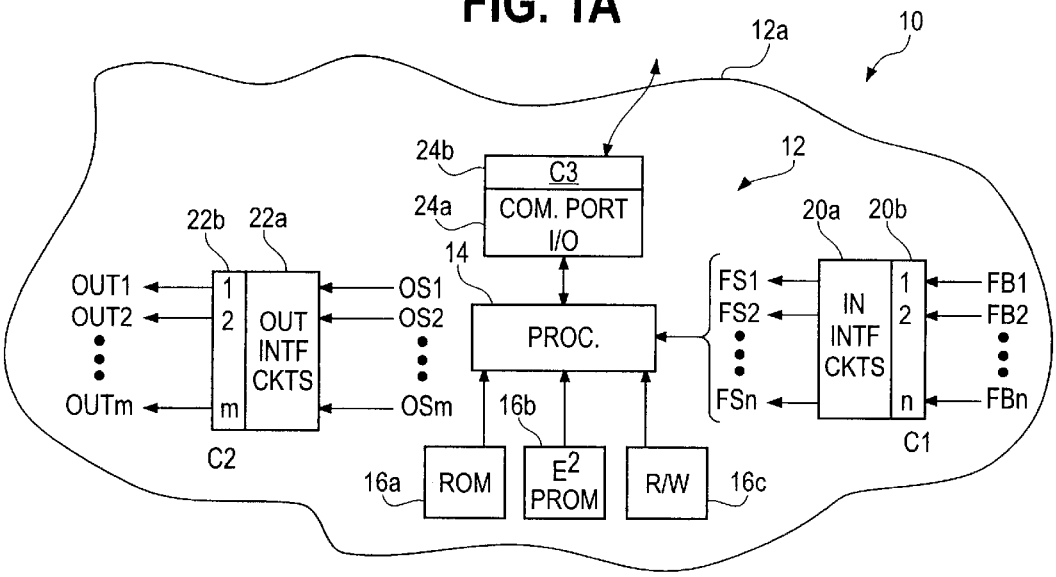
FIGS. 1*a* and 1*b* are multiple block diagram views of a system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1*a* is a block diagram of a multi-pump control system 10. This system 10 includes a unitary control module 12 having a planer support member 12*a*.

The module 12 carries a programable processor 14. The processor 14 is coupled to storage units previously loaded with control programs and operating parameters. The storage units include read only memory 16*a*, read write read only memory (EEPROM) 16*b* and read/write memory 16*c*.

The module 12 carries input interface circuitry 20*a* which receives as inputs, via an input connector 20*b*, level control signals FB1, FB2 . . . FBn. Output signals from interface circuitry 20*a*, FS1, FS2 . . . FSn corresponding to the input feedback signals FB1, FB2 . . . FBn are in turn coupled to input ports of the processor 14.

Also coupled to processor 14 are output interface circuits 22*a*. Processor 14 generates output control signals OS1 . . . OSm for purposes of driving a plurality of pumps.

Output interface circuitry 22*a* converts the signals from processor 14 to respective pump drive signals OUT1 . . . OUTm. The pump output signals can be coupled by a connector 22*b* to respective pumps P1, P2 . . . Pm.

Module 12 also carries an auxiliary input/output communication port, which for example could correspond to an RS-232 type dial-up interface 24*a*. The interface 24*a* is in bidirectional communication with processor 14. Module 12 can be coupled to a remote communications system by connector 24*a*.

Figure 1B:
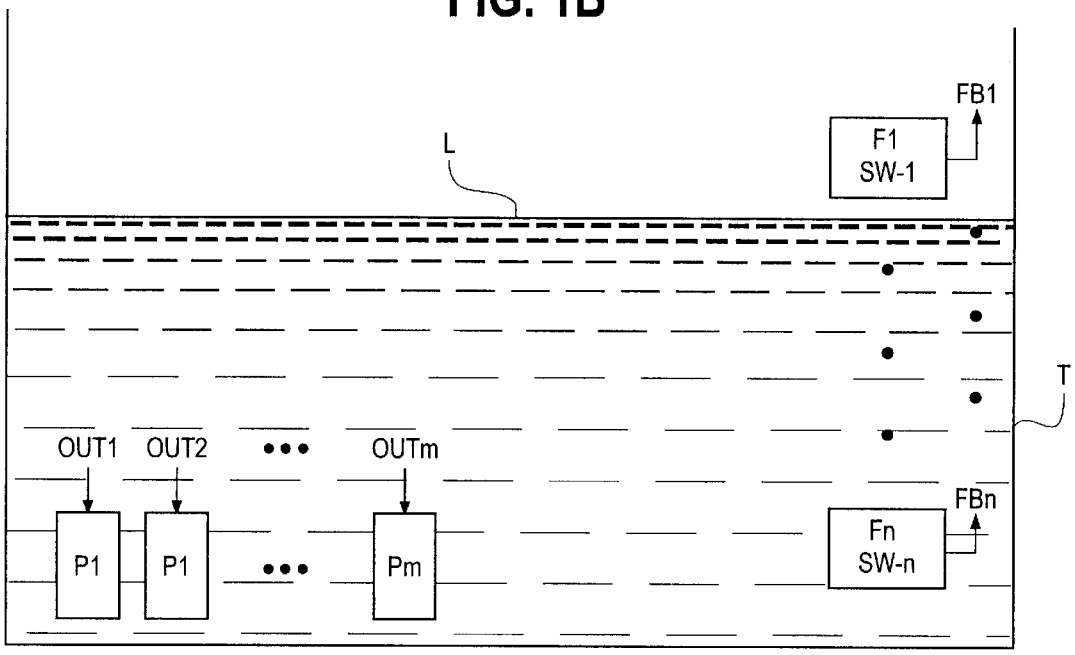
Figure 2:
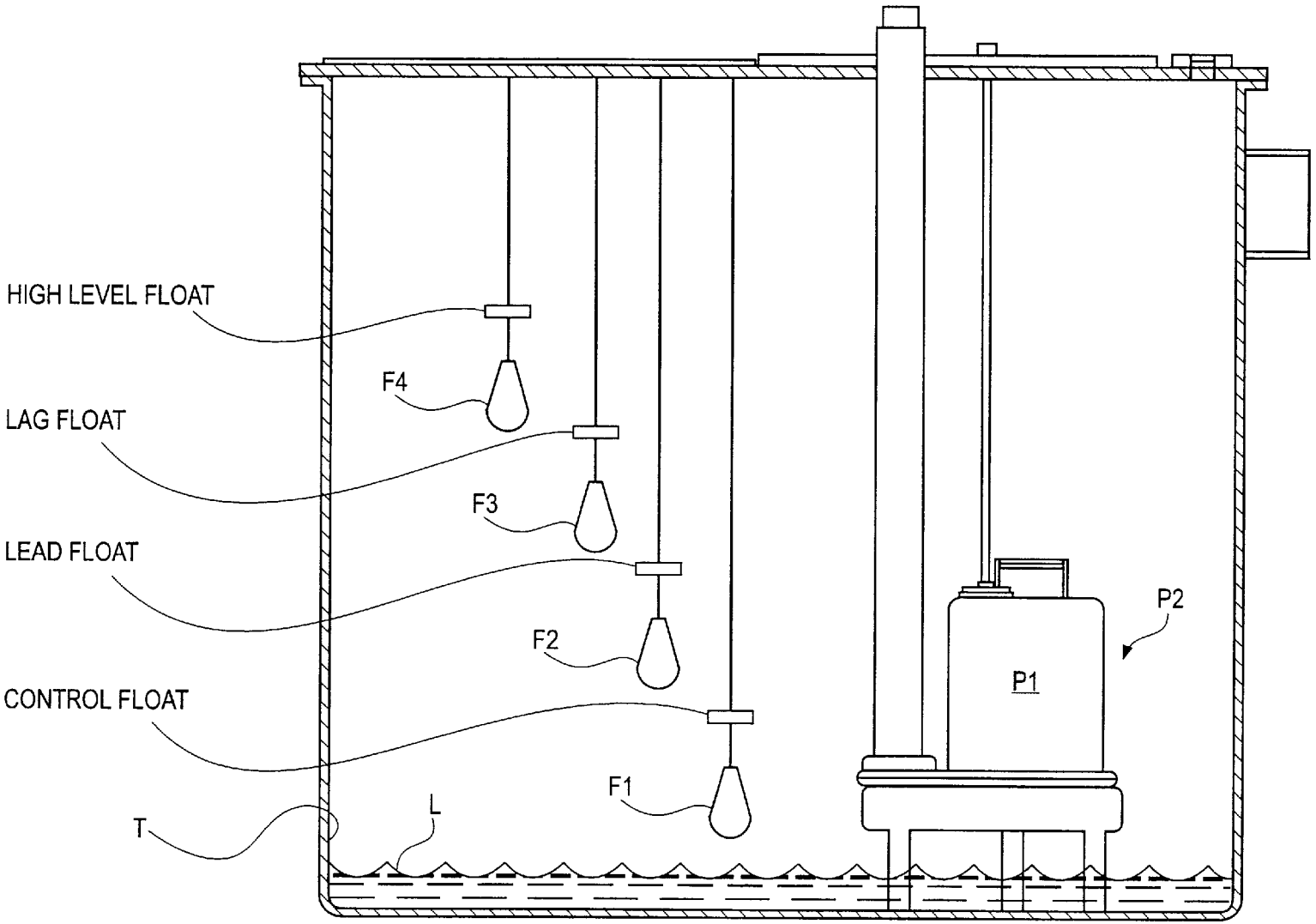
FIGS. 2–35 taken together as a set of diagrams illustrating various operational conditions in describing operation of the control software of the system of FIGS. 1*a* and 1*b*.
Figure 3:
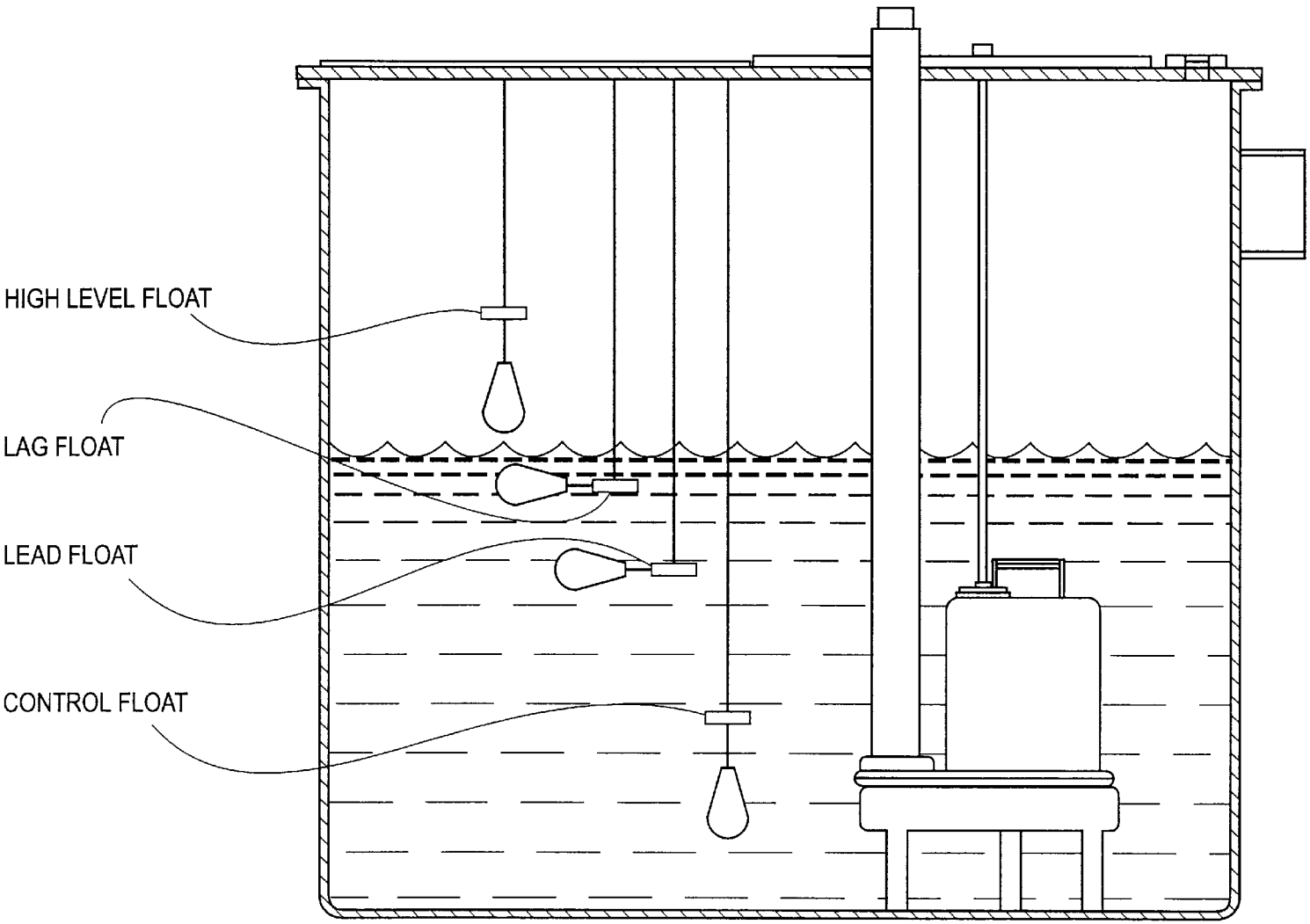
Figure 4:
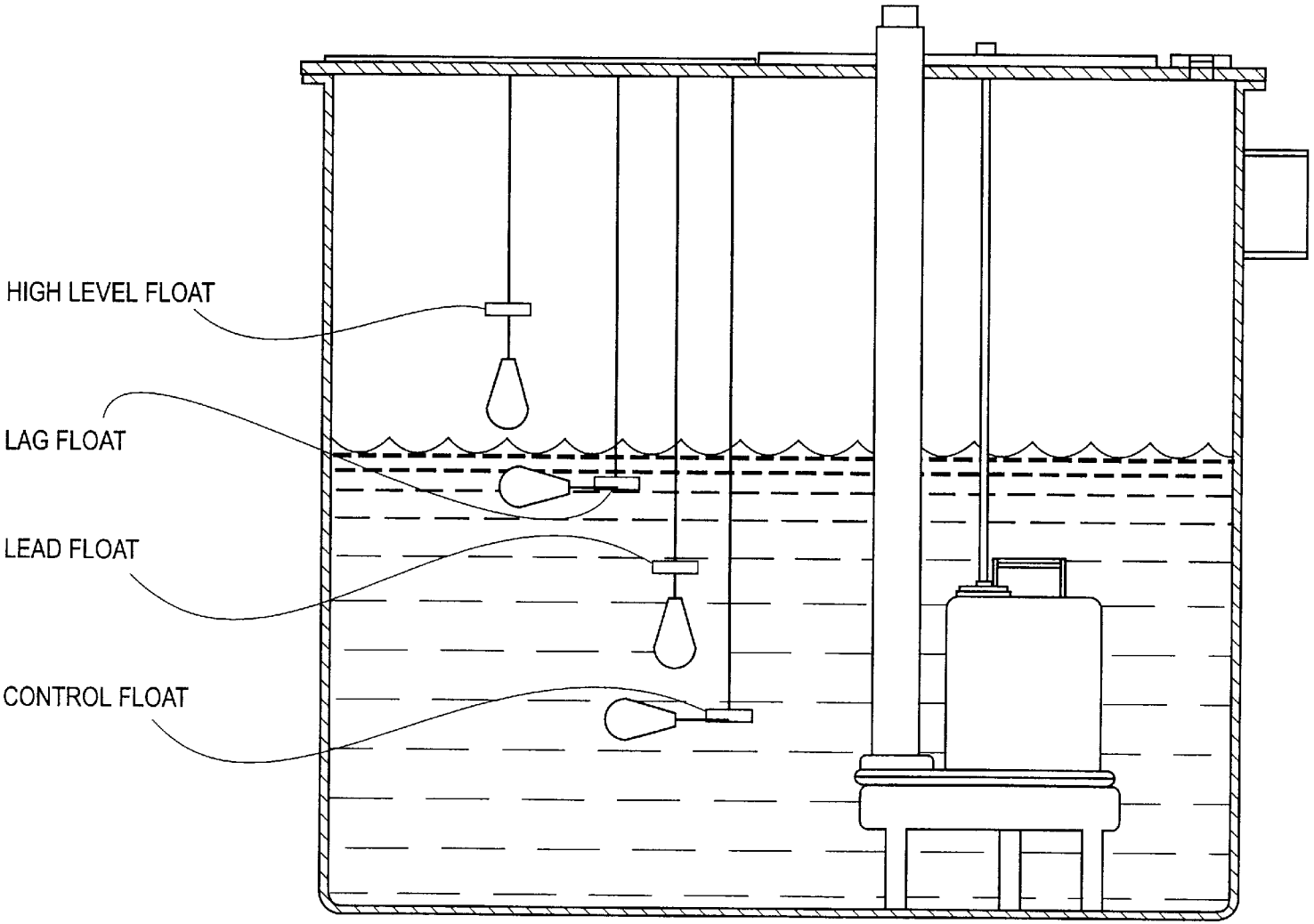
Figure 5:
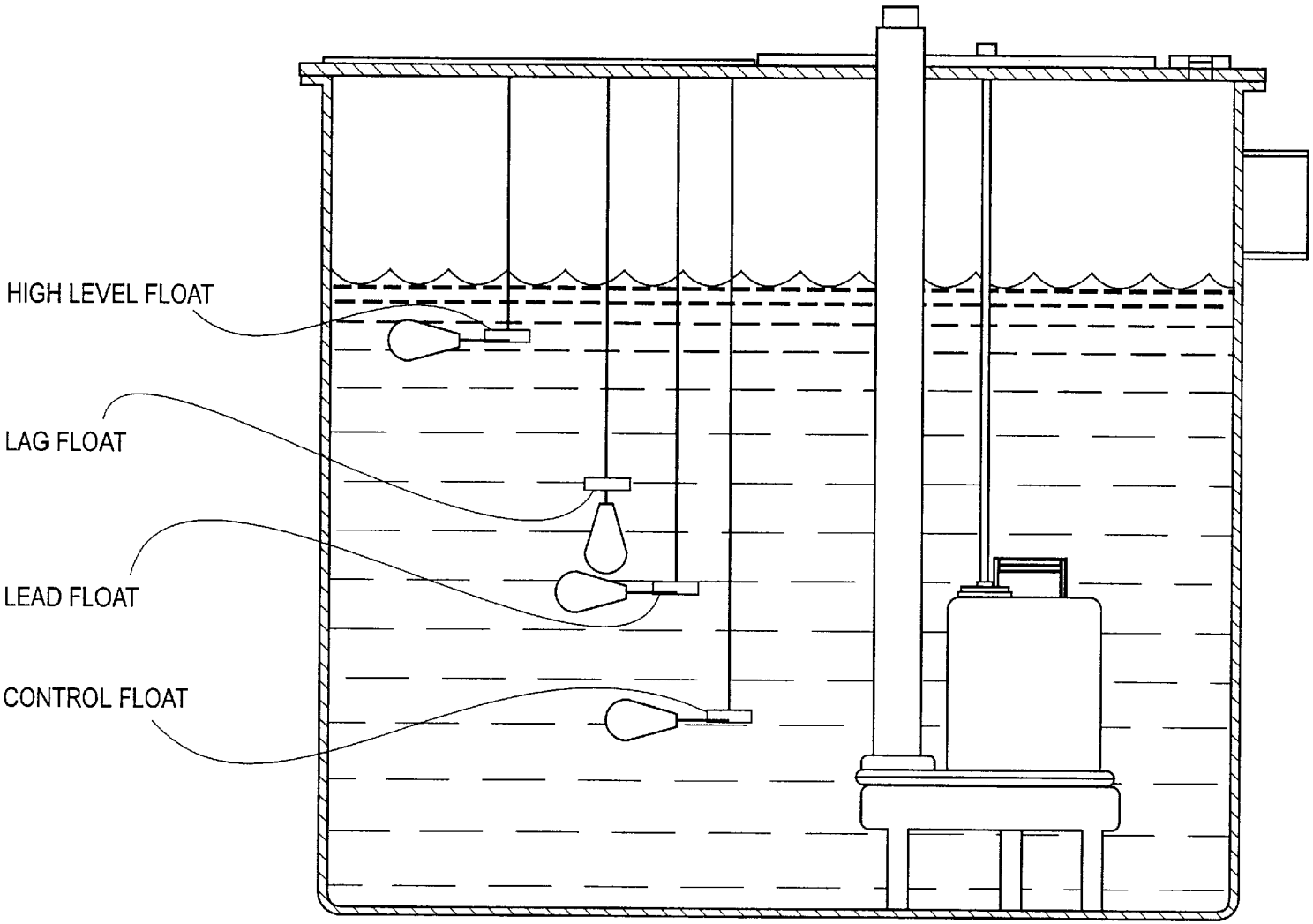
Figure 6:
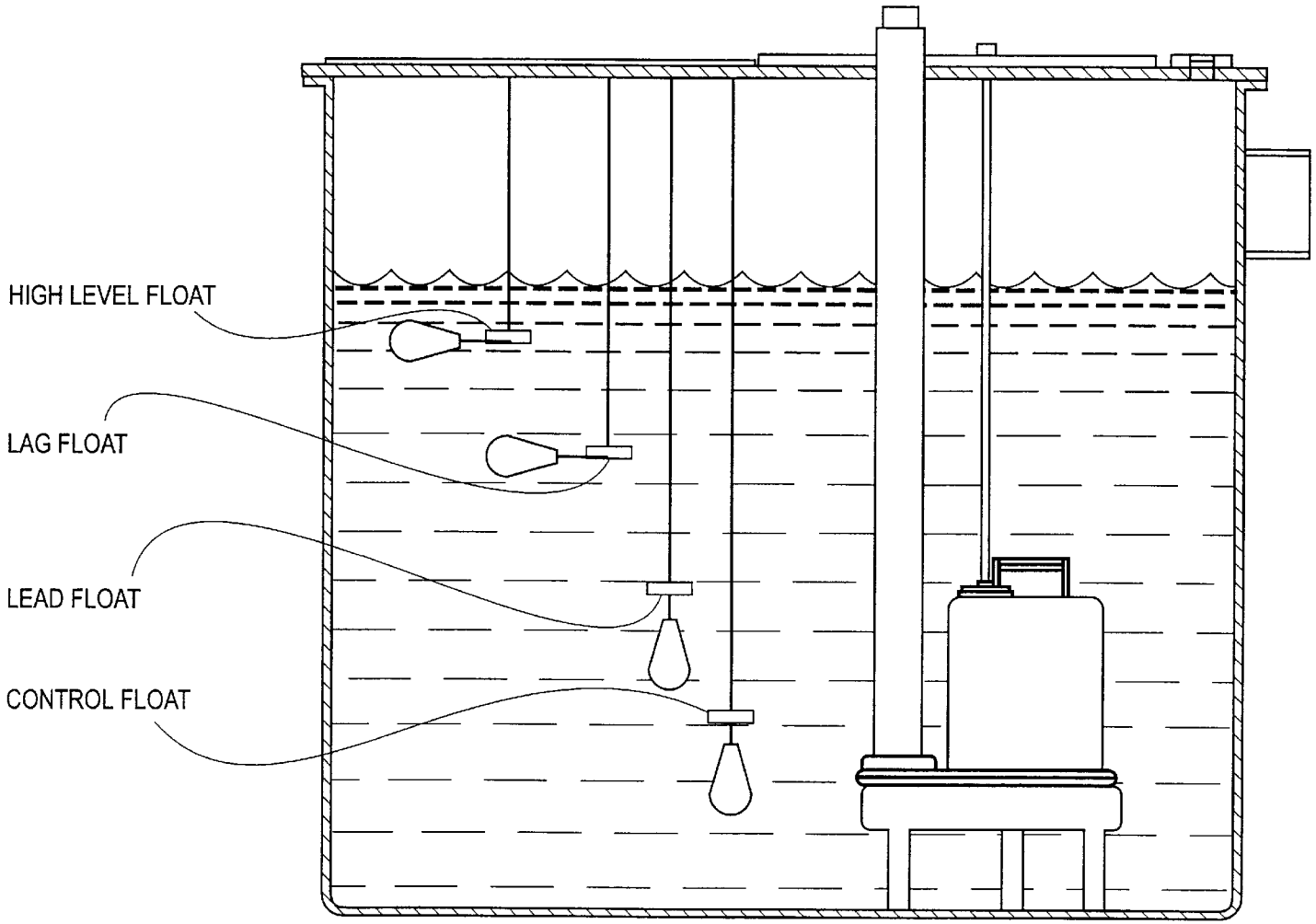
Figure 7:
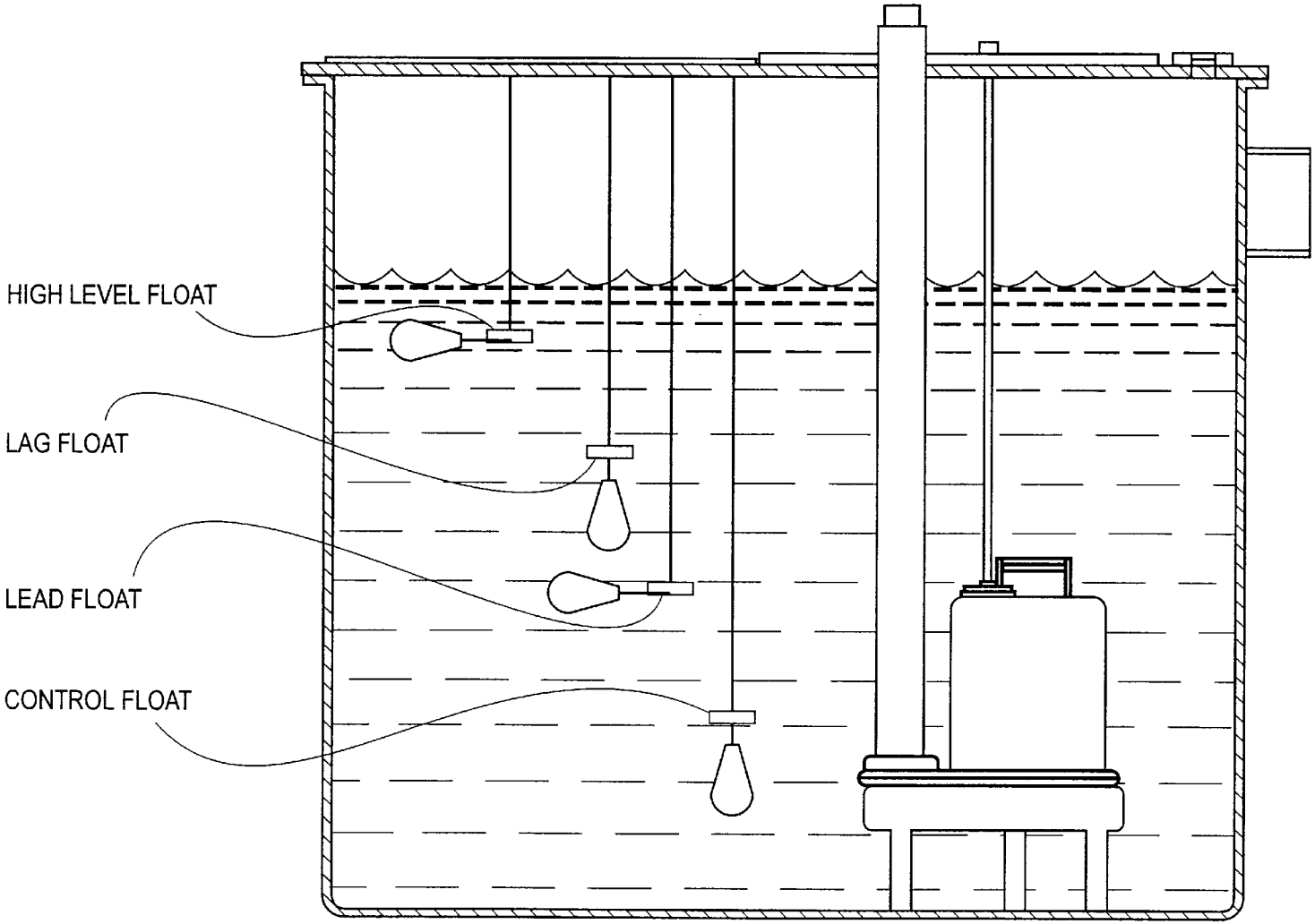
Figure 8:
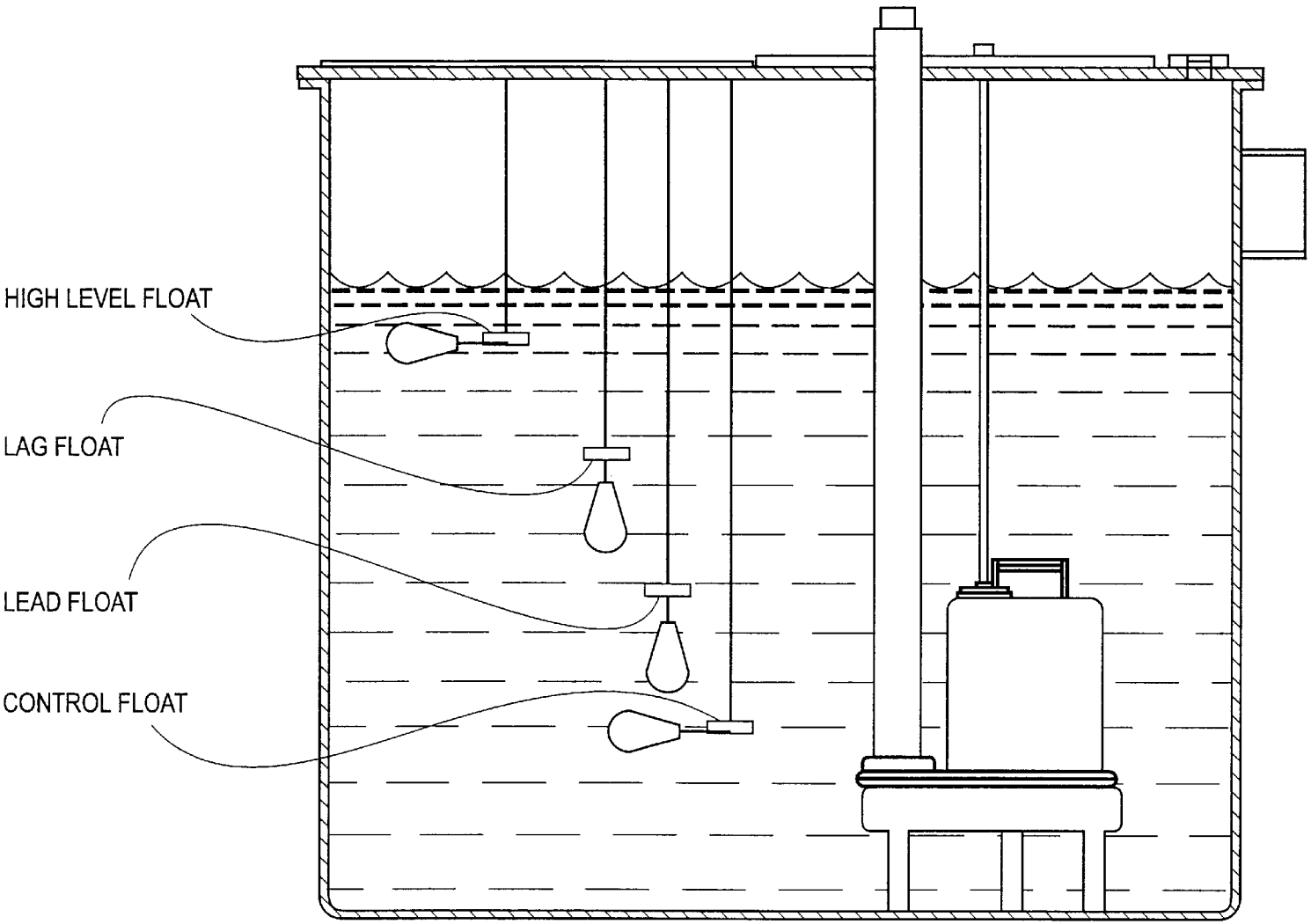
Figure 9:
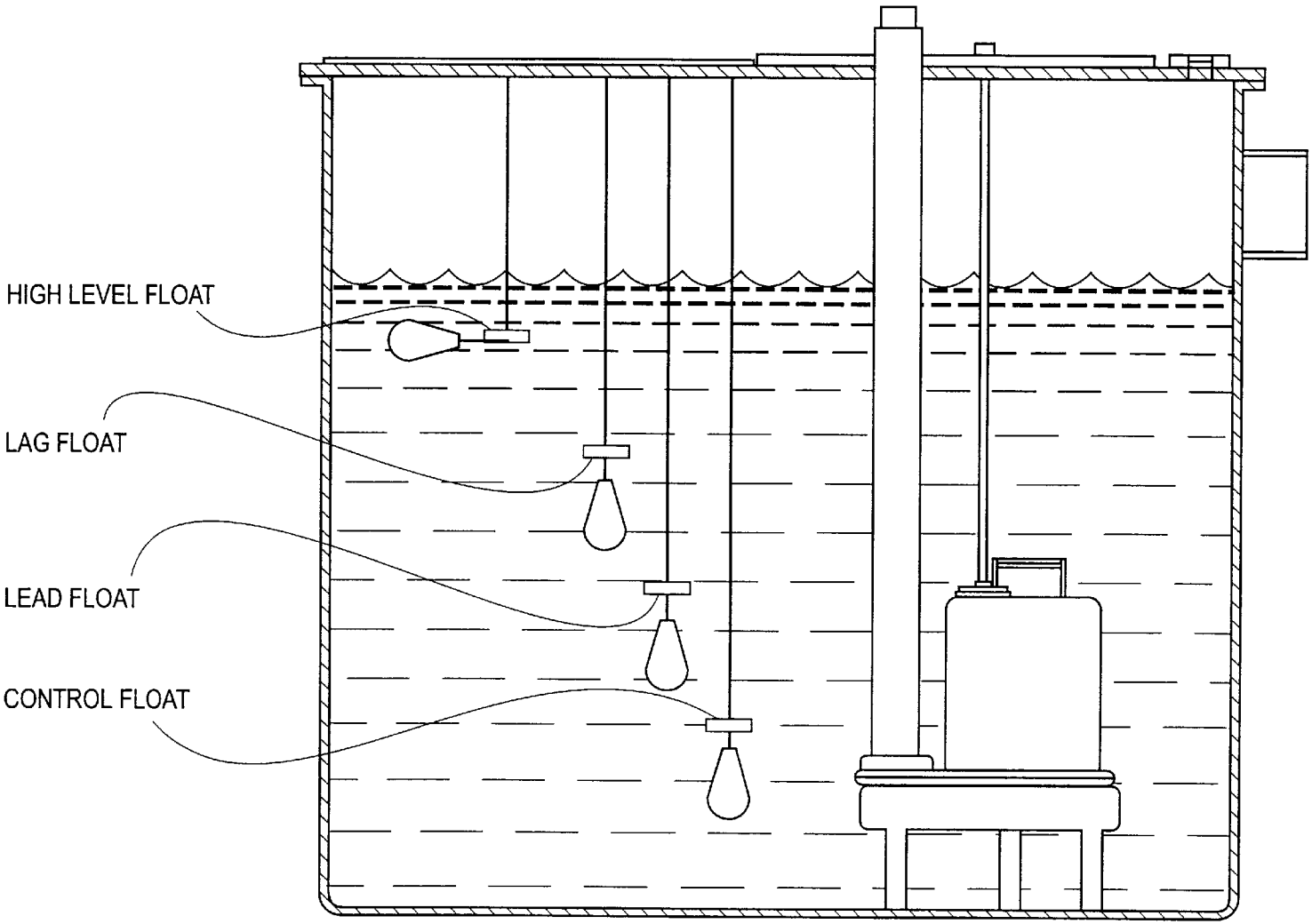
Figure 10:
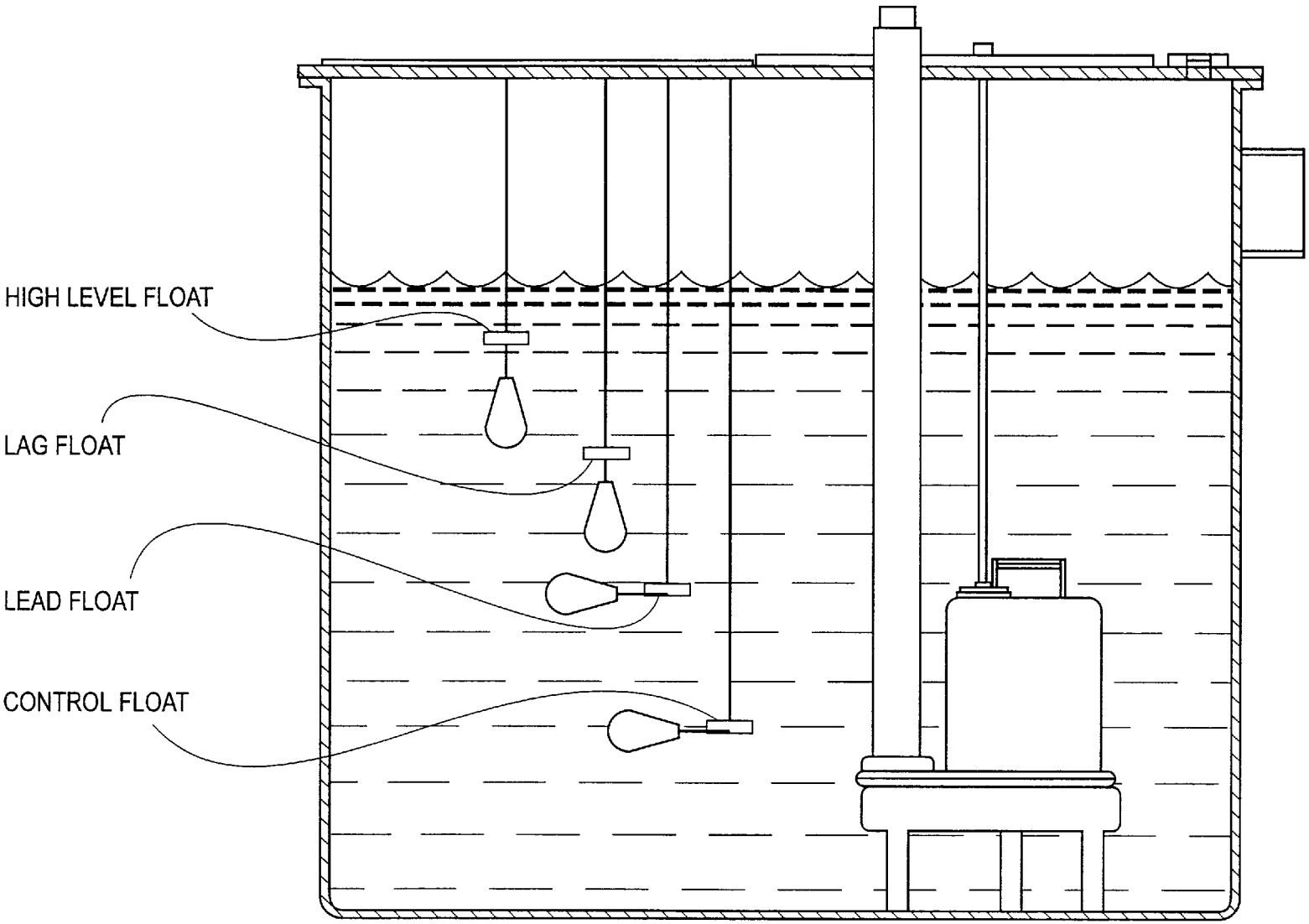
Figure 11:
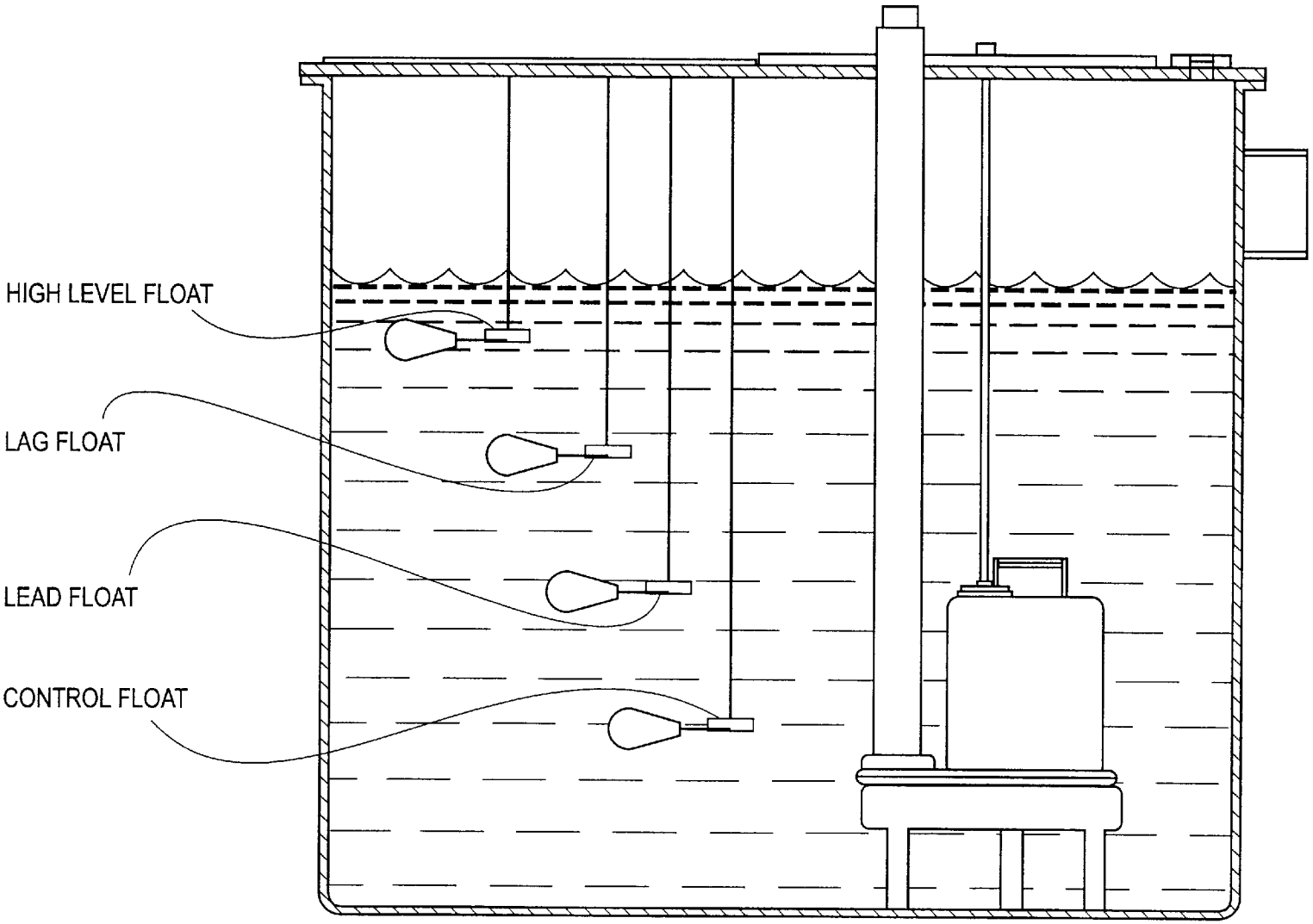
Figure 12:
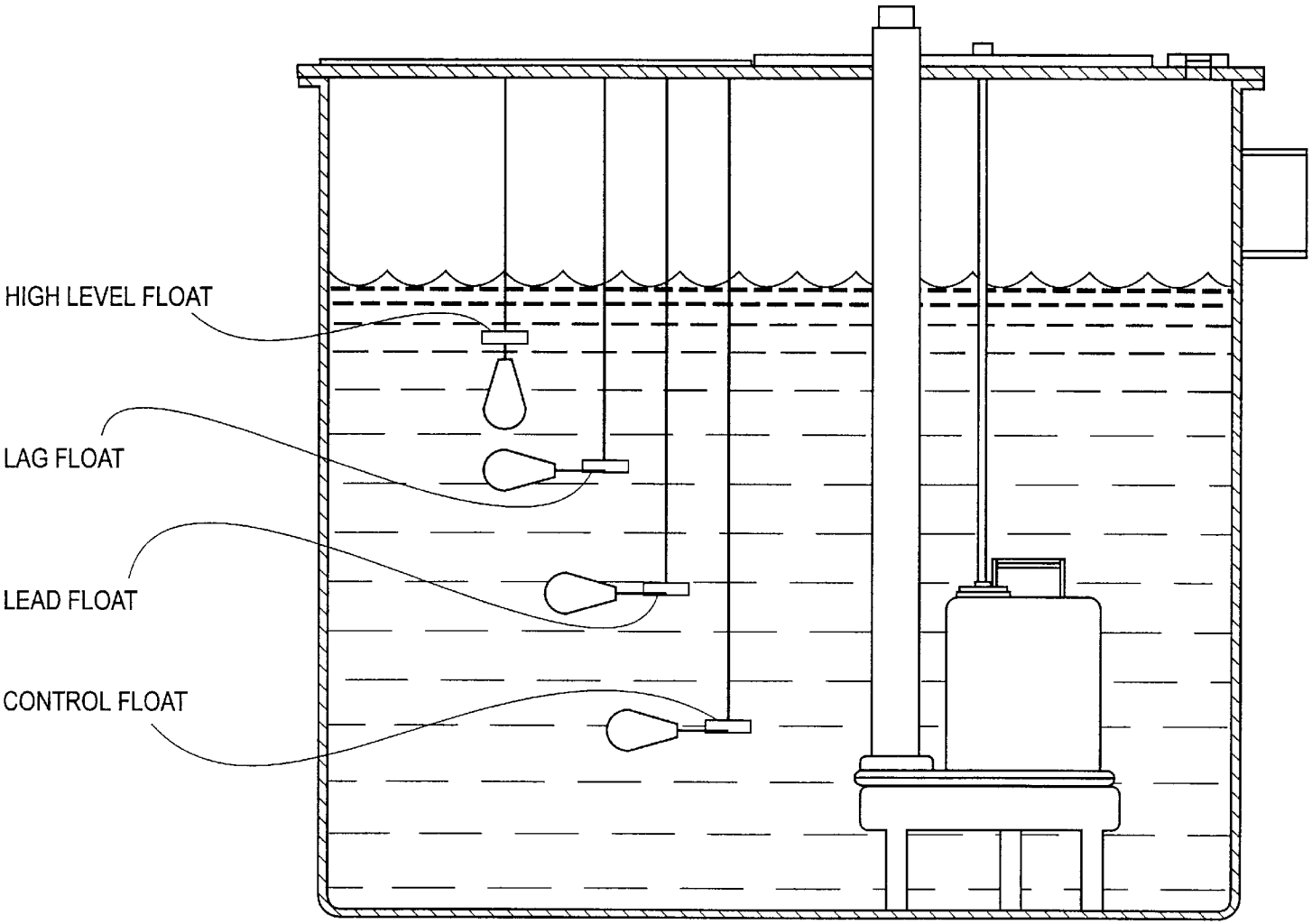
Figure 13:
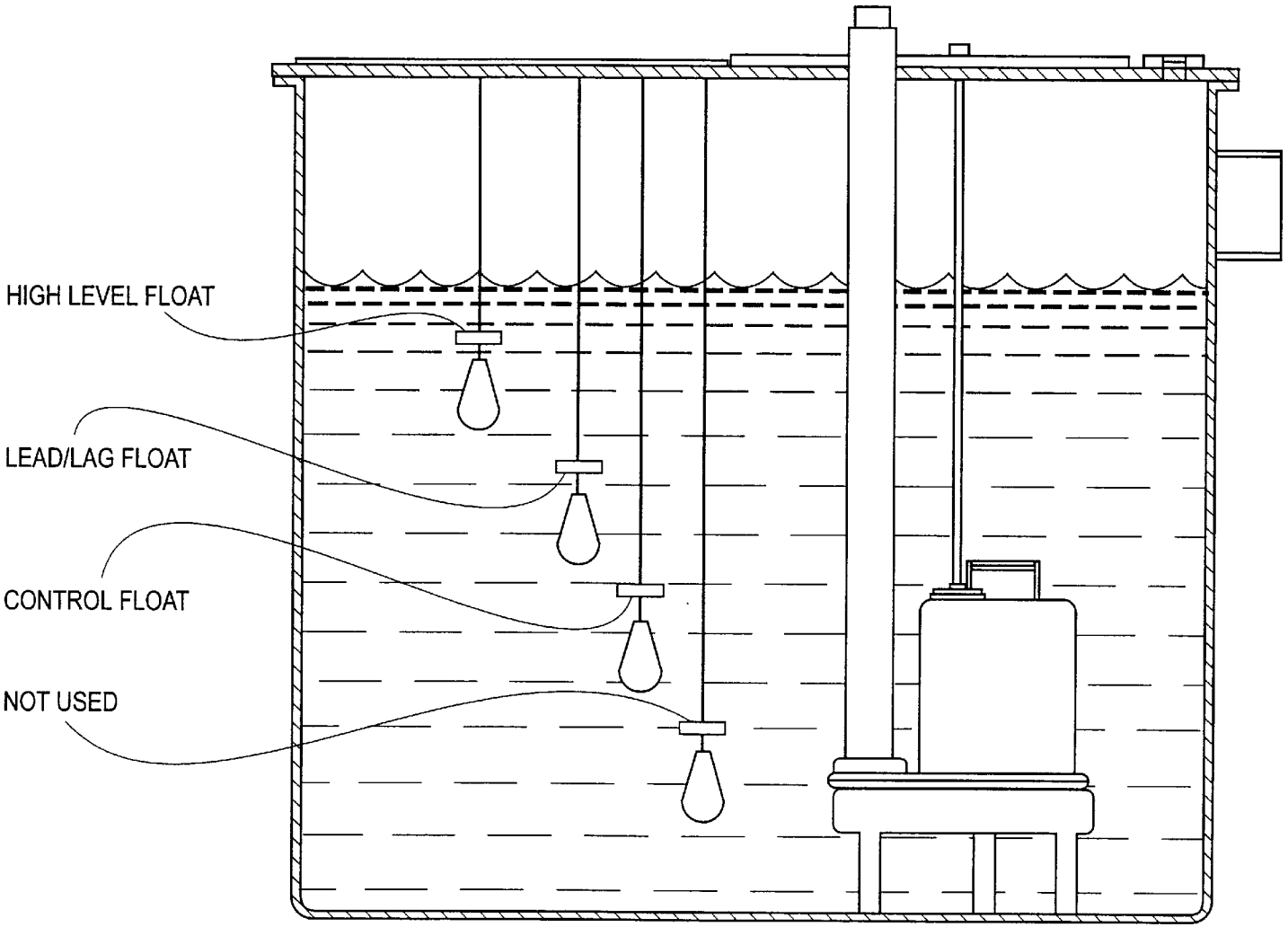
Figure 14:
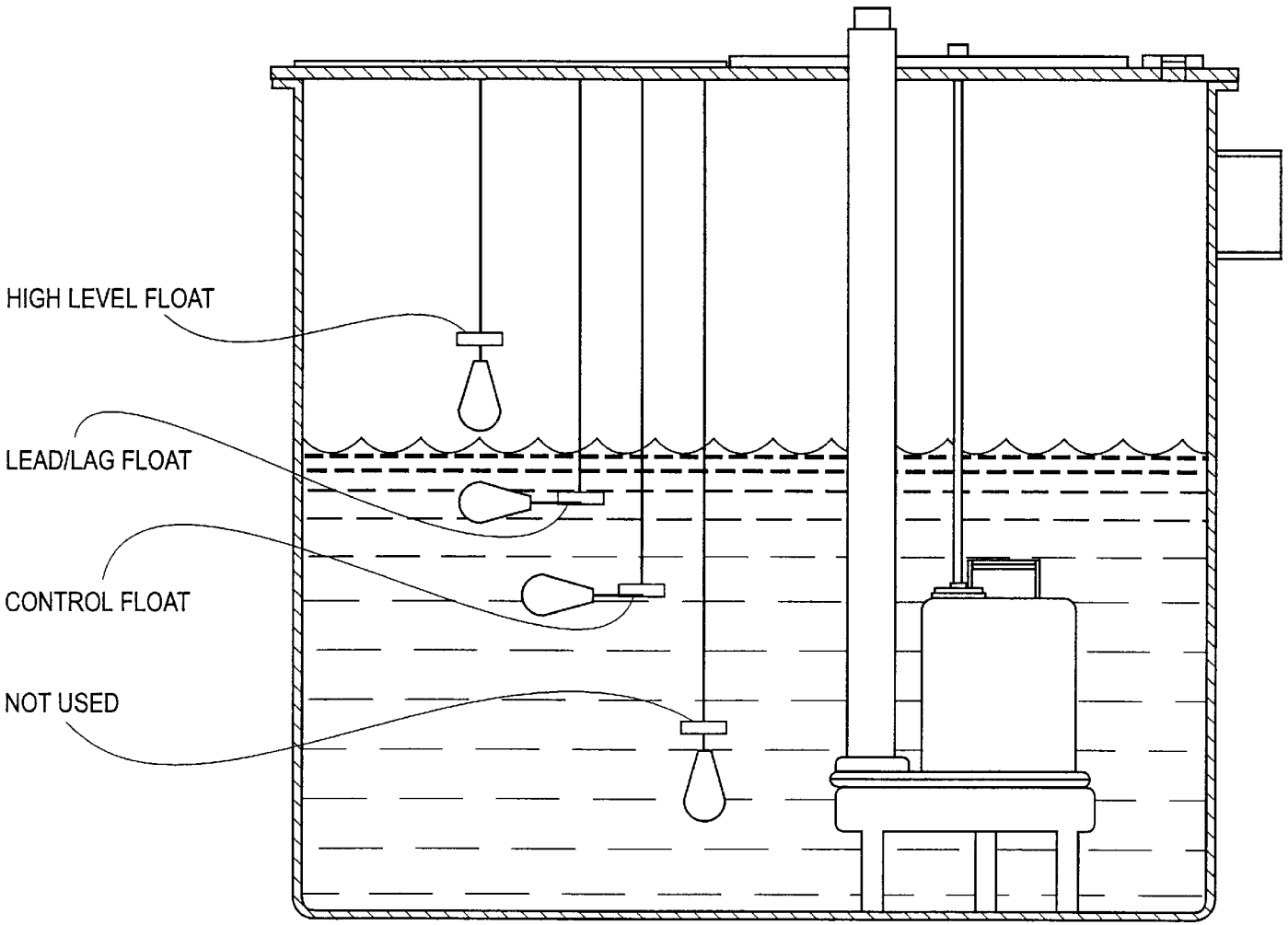
Figure 15:
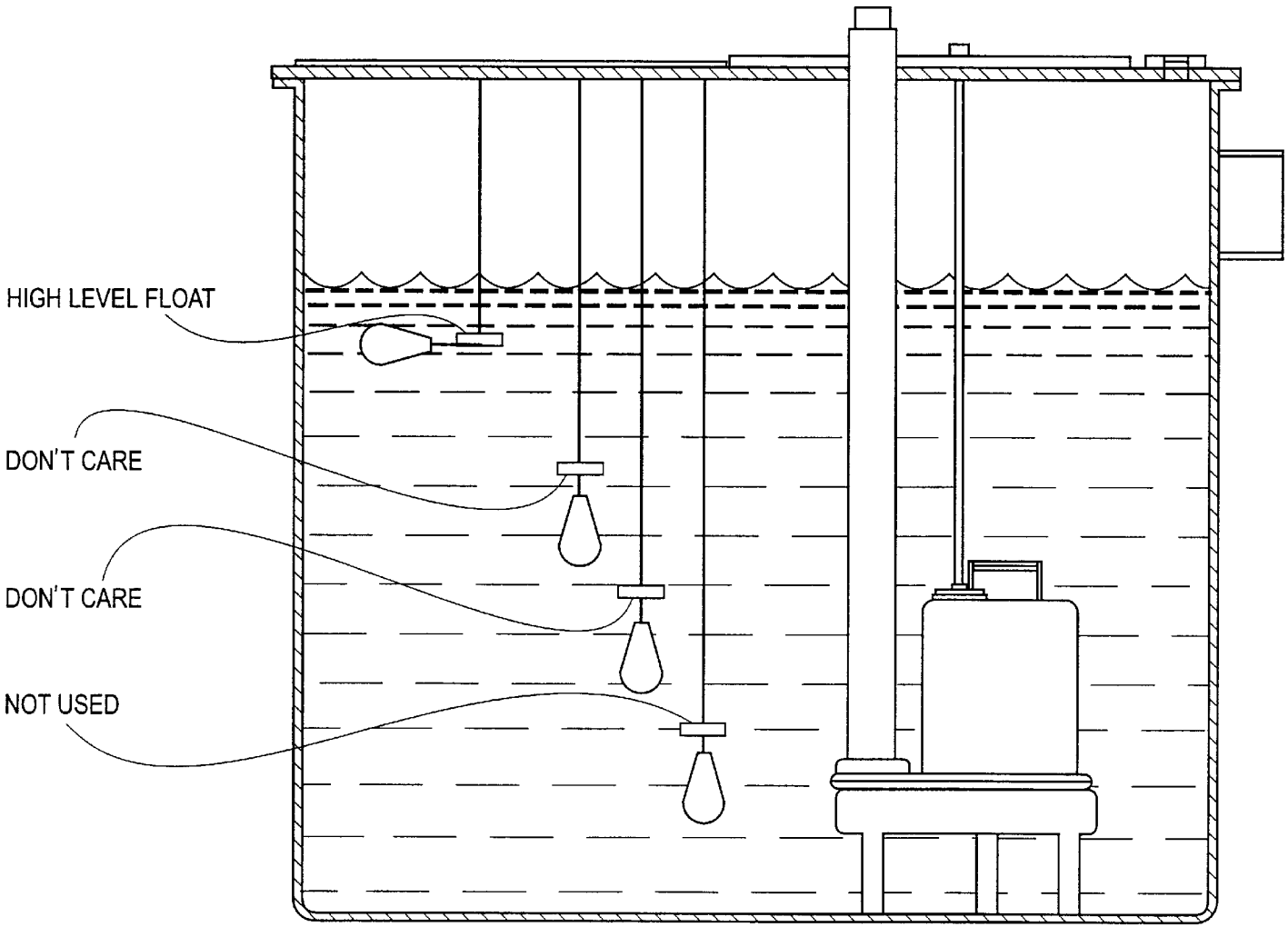
Figure 16:
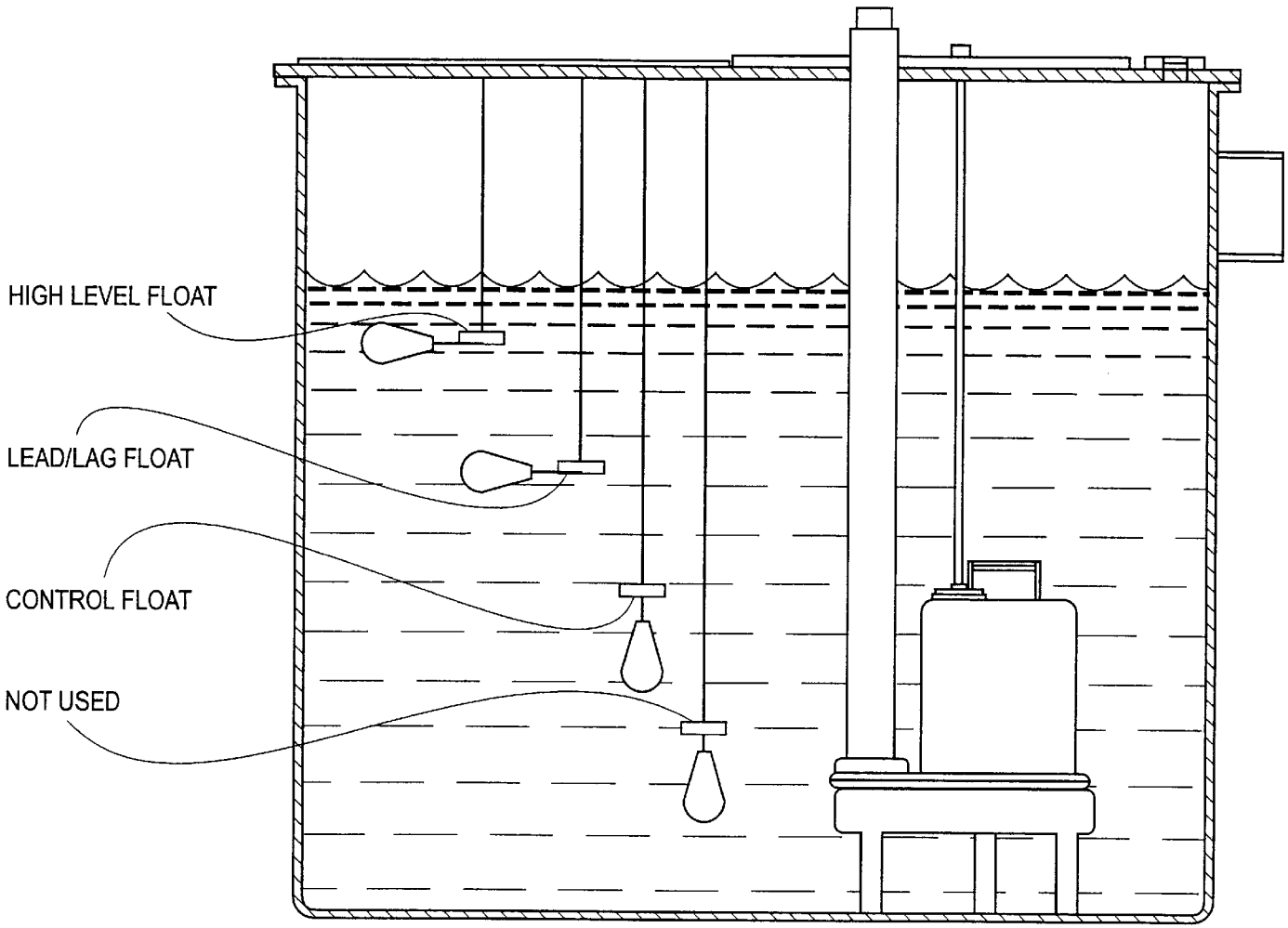
Figure 17:
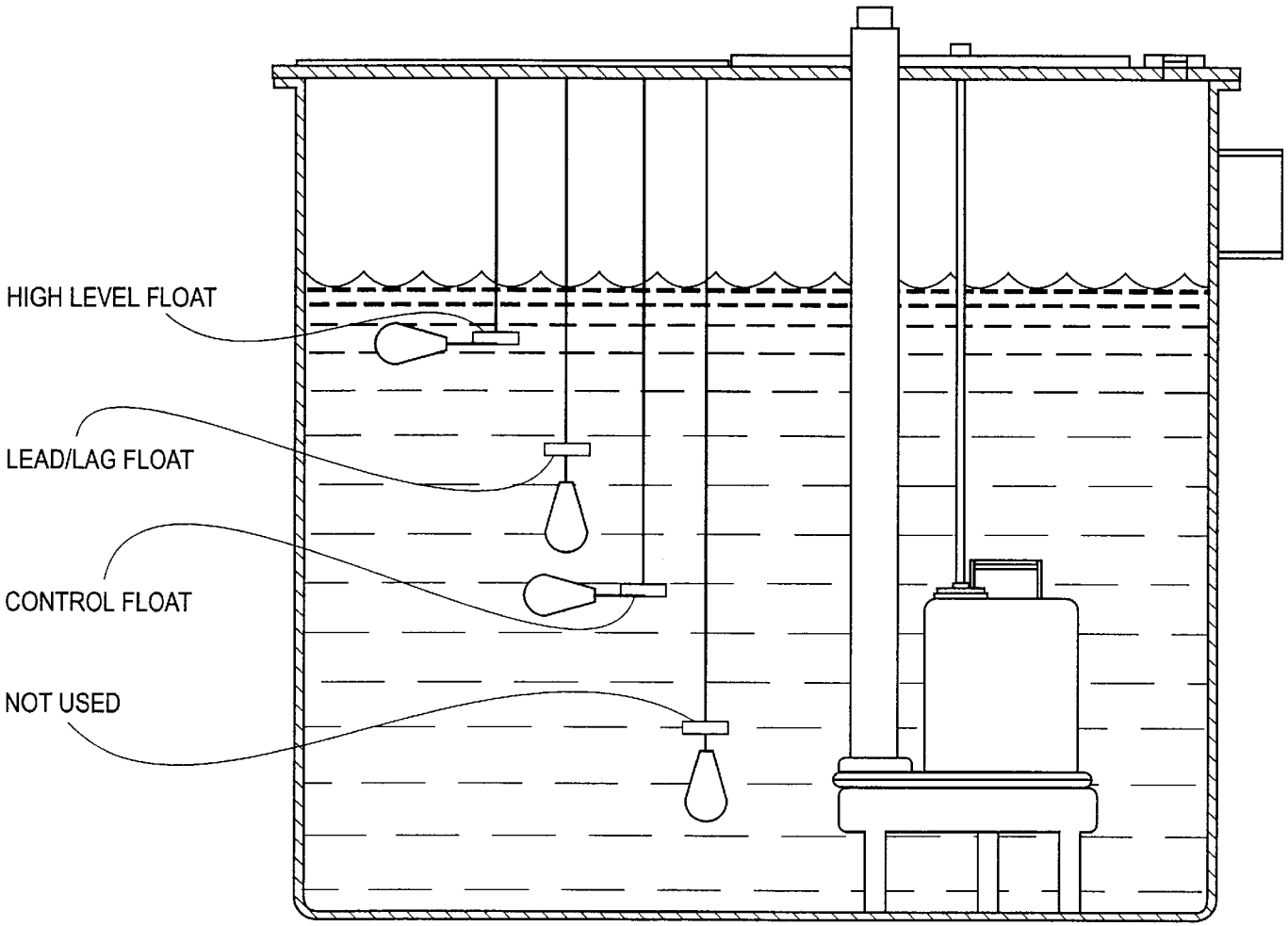
Figure 18:
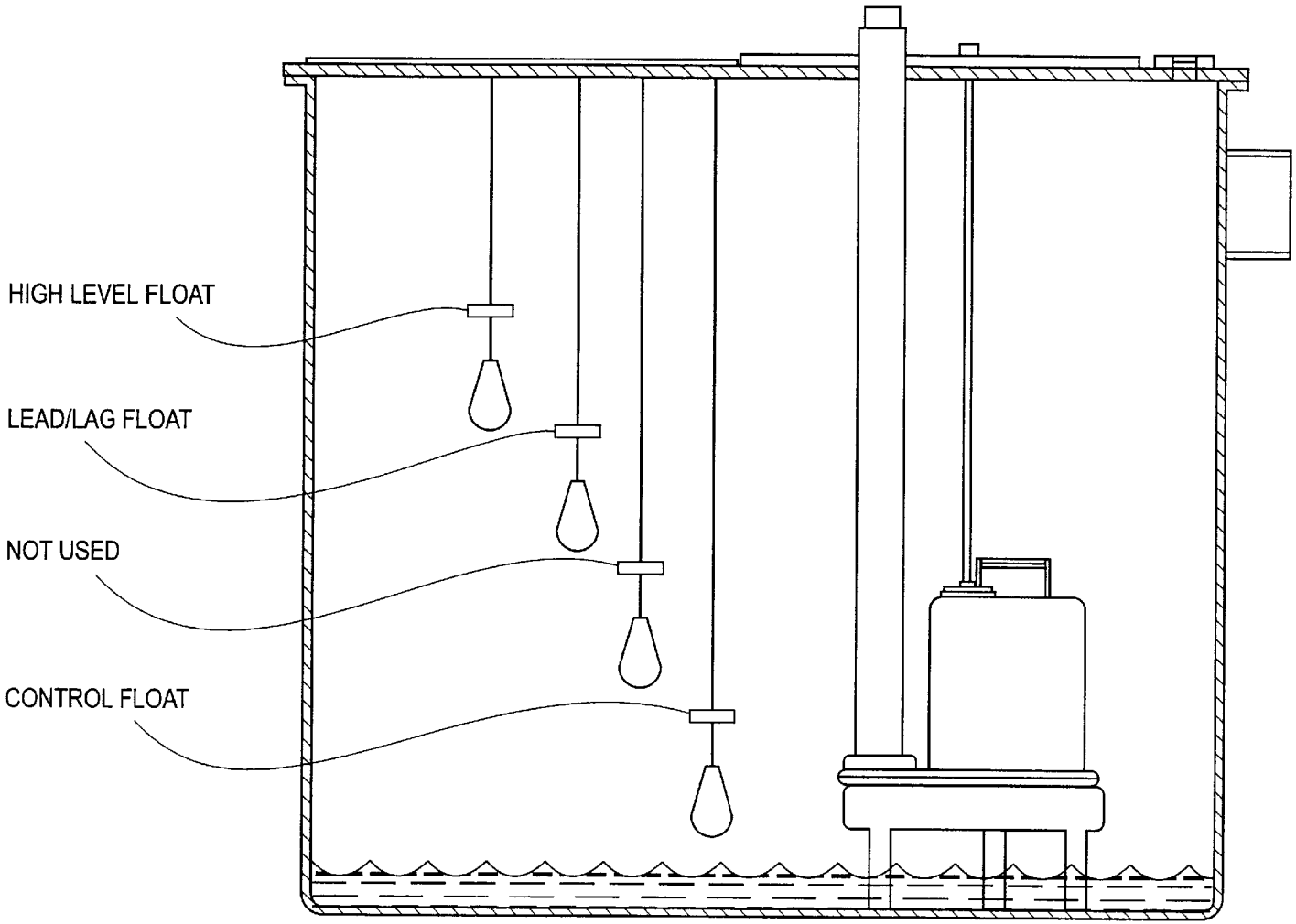
Figure 19:
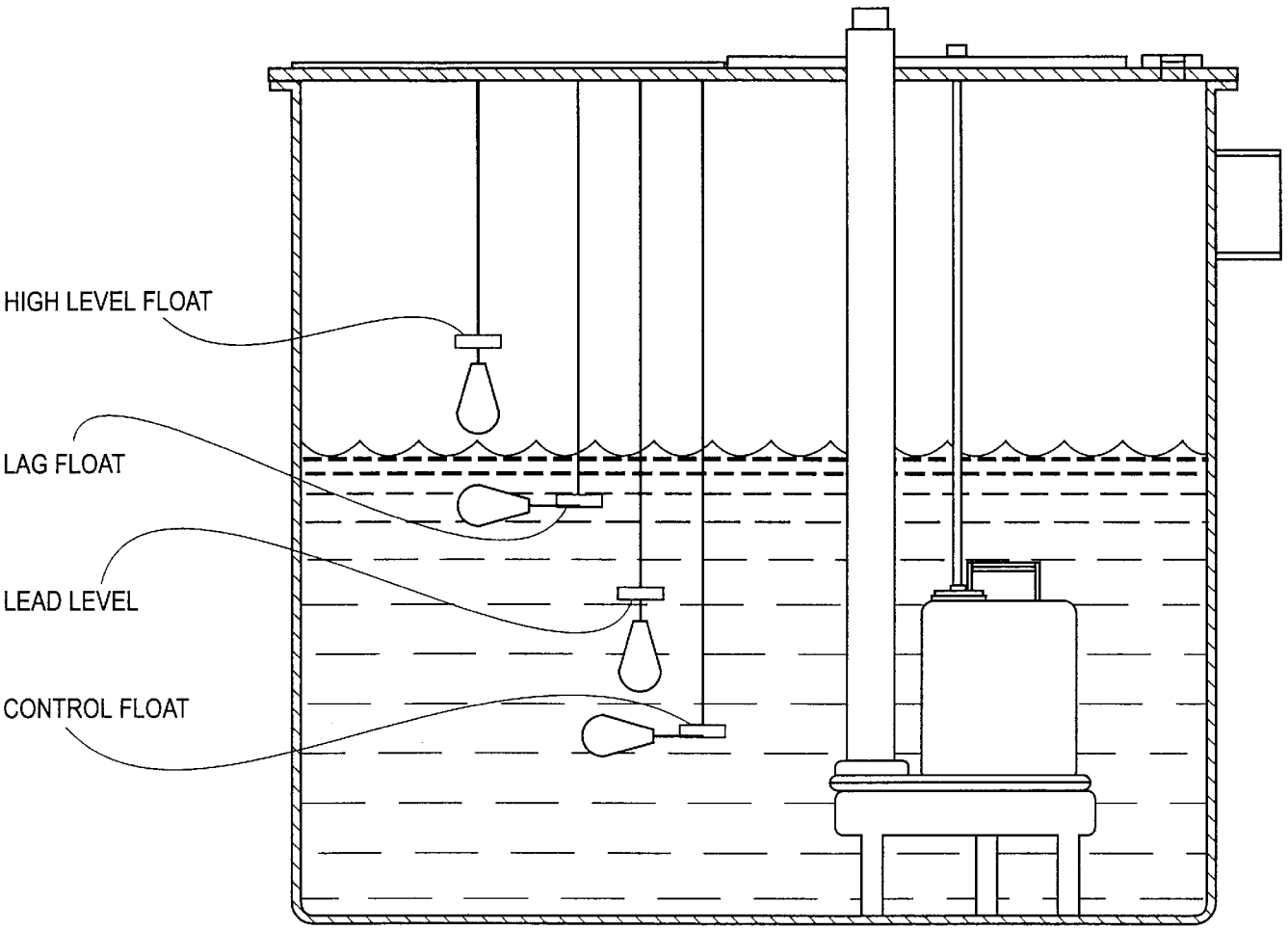
Figure 20:
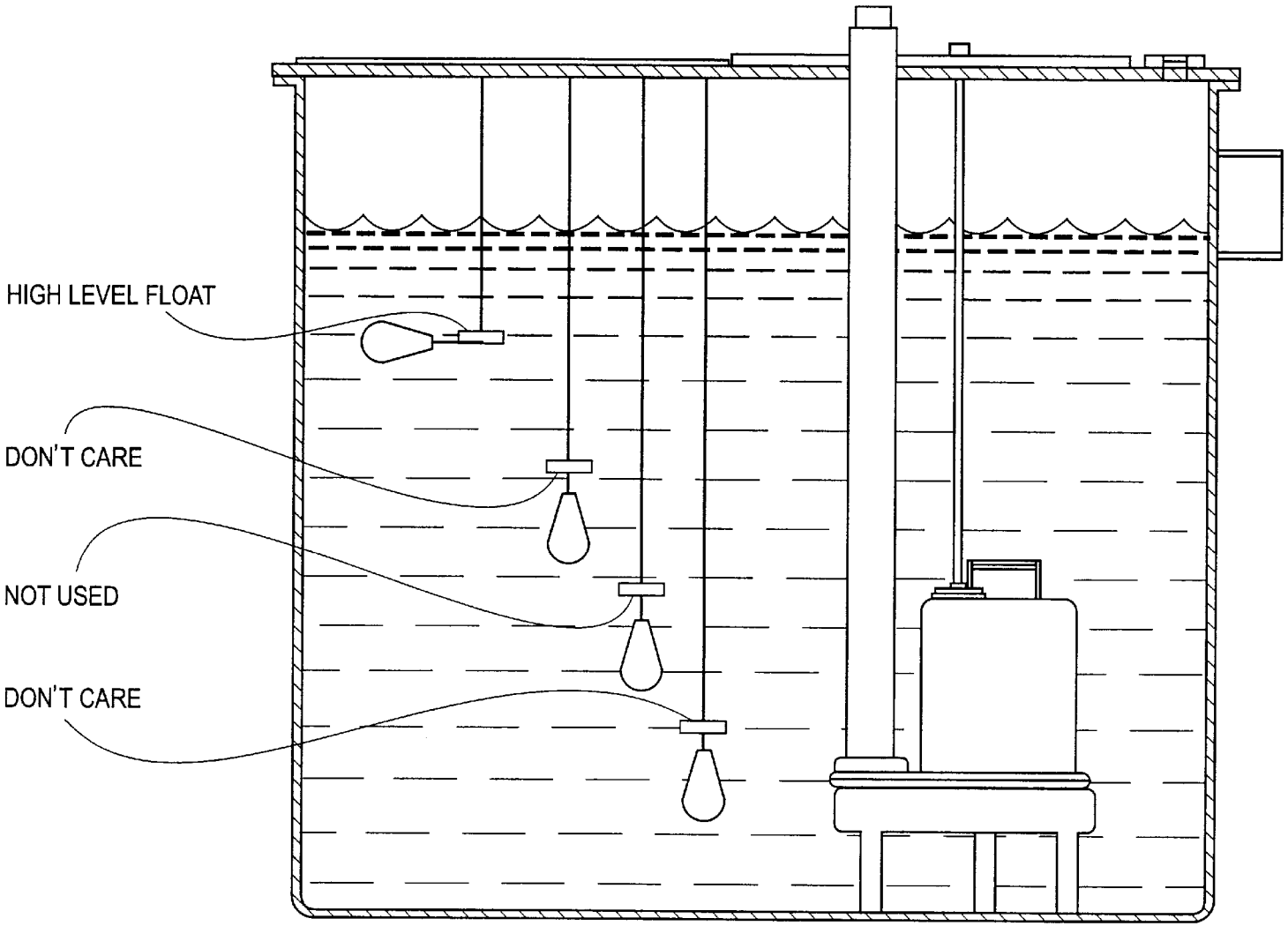
Figure 21:
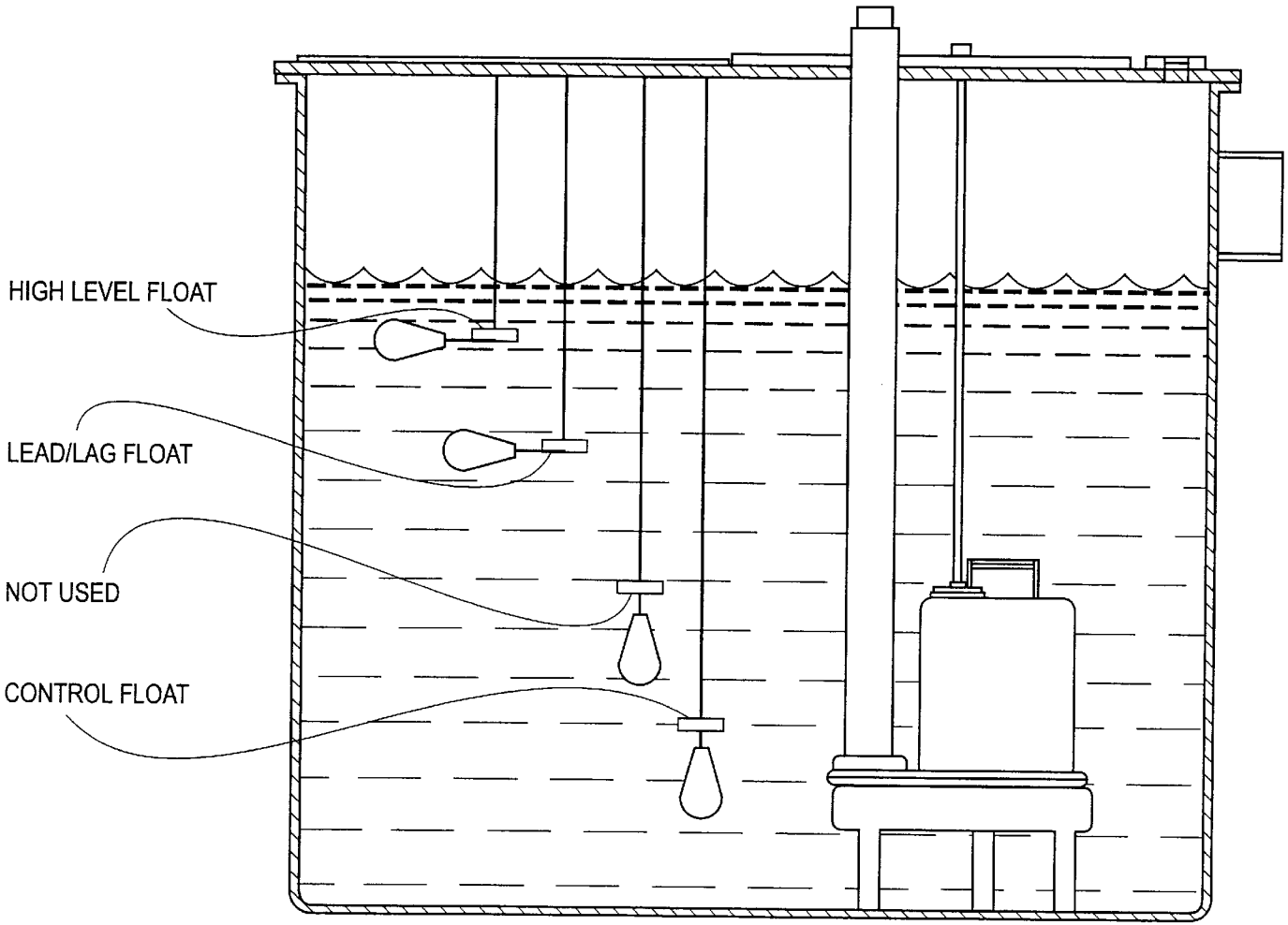
Figure 22:
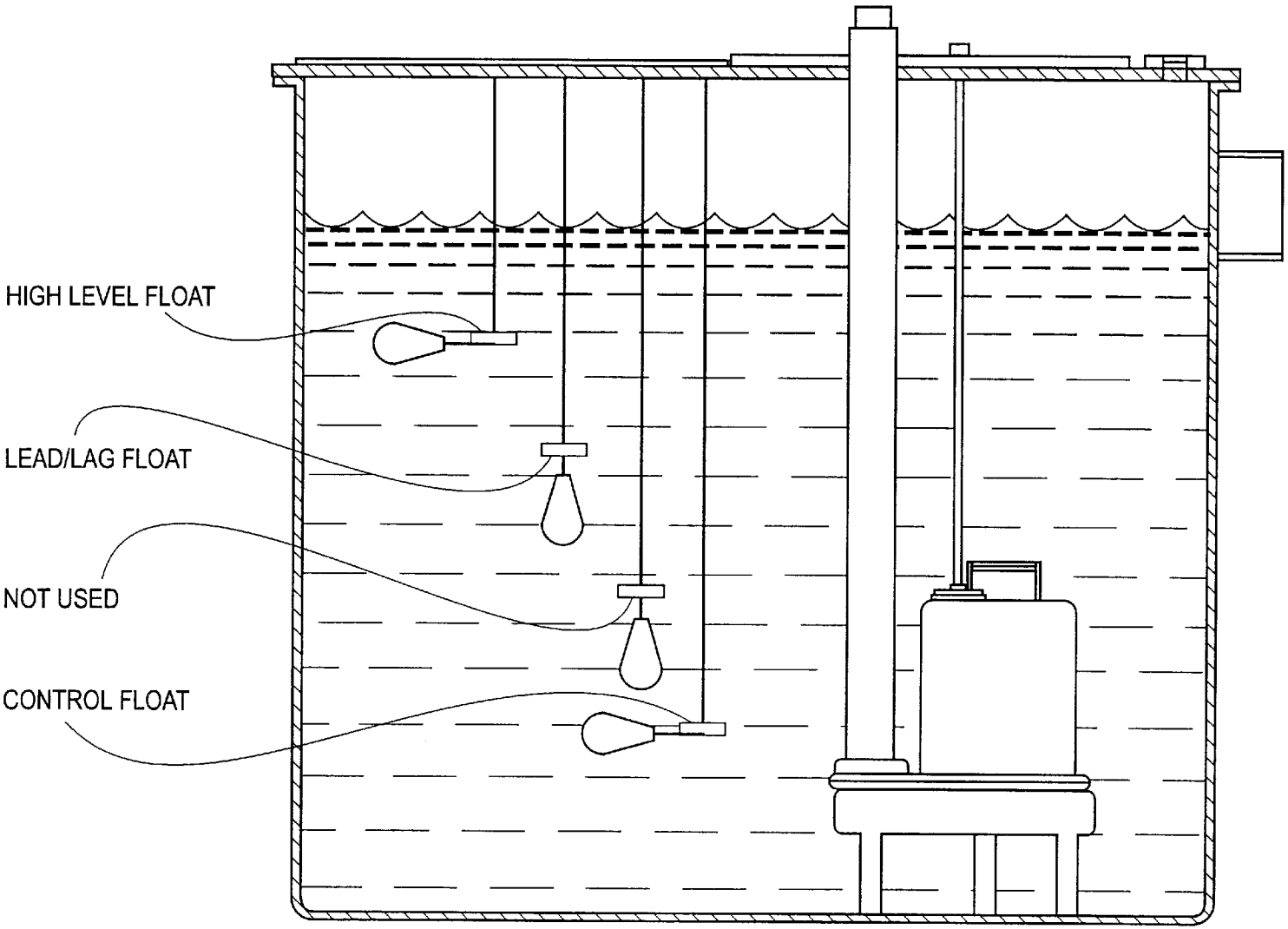
Figure 23:
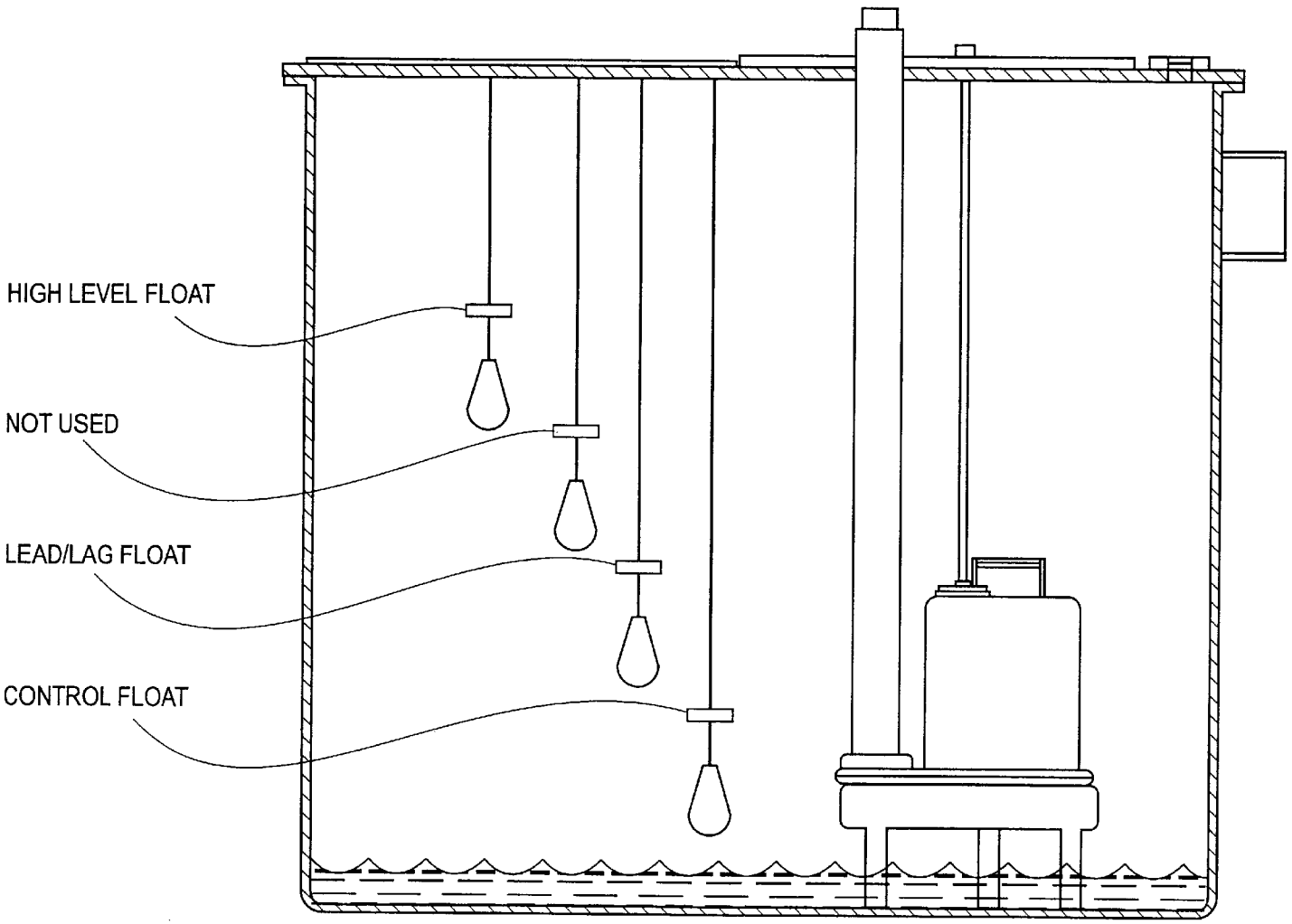
Figure 24:
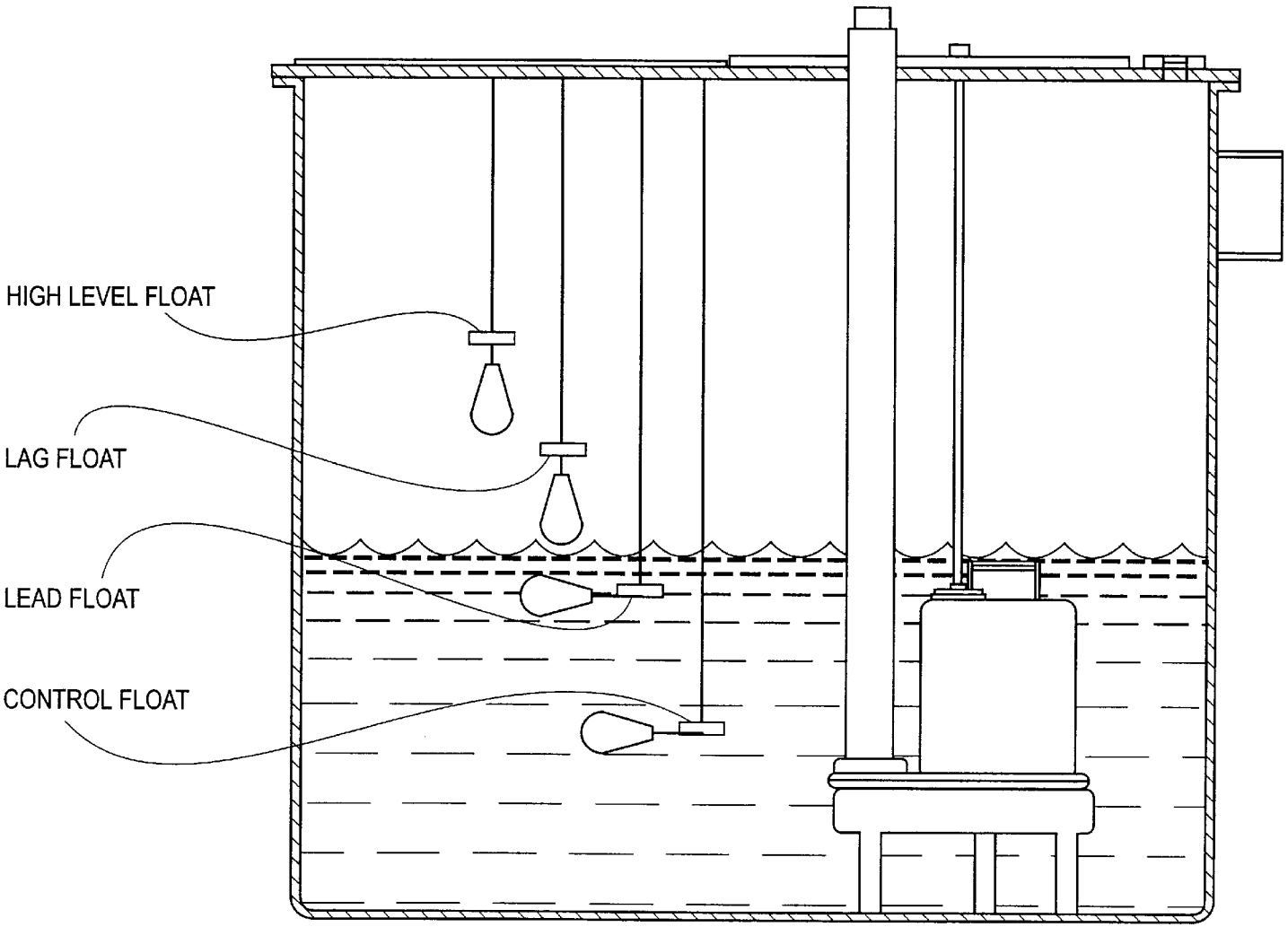
Figure 25:
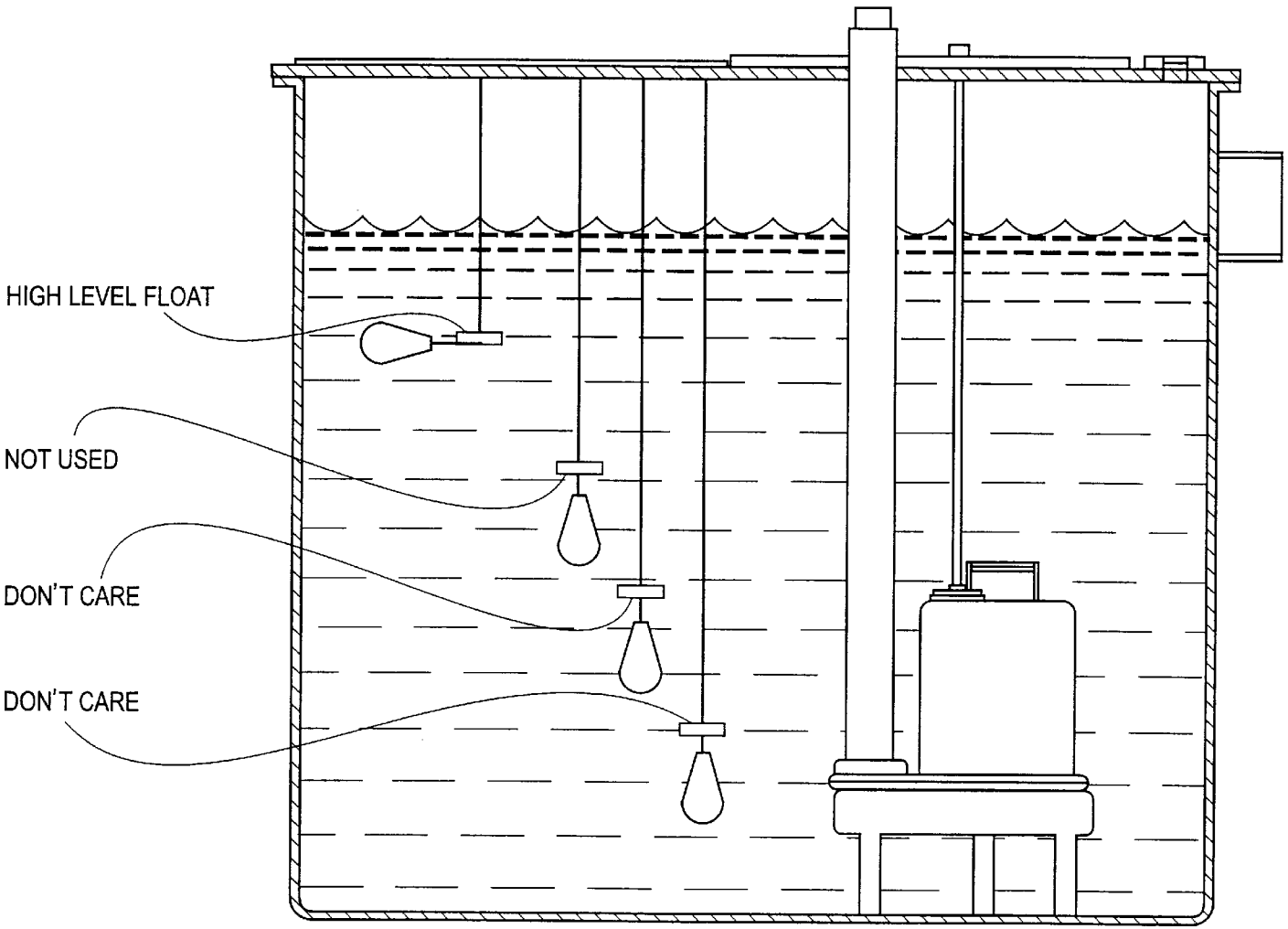
Figure 26:
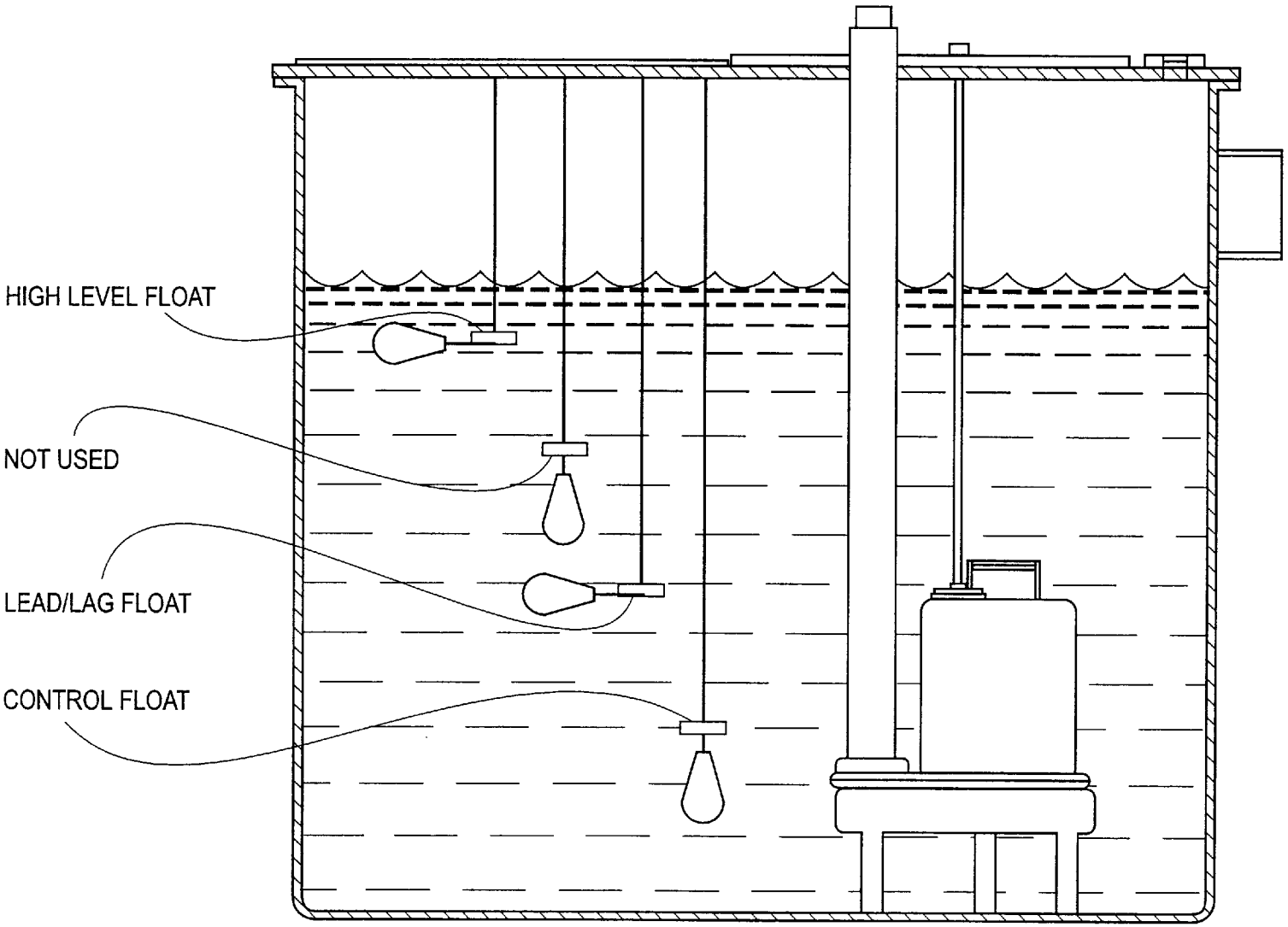
Figure 27:
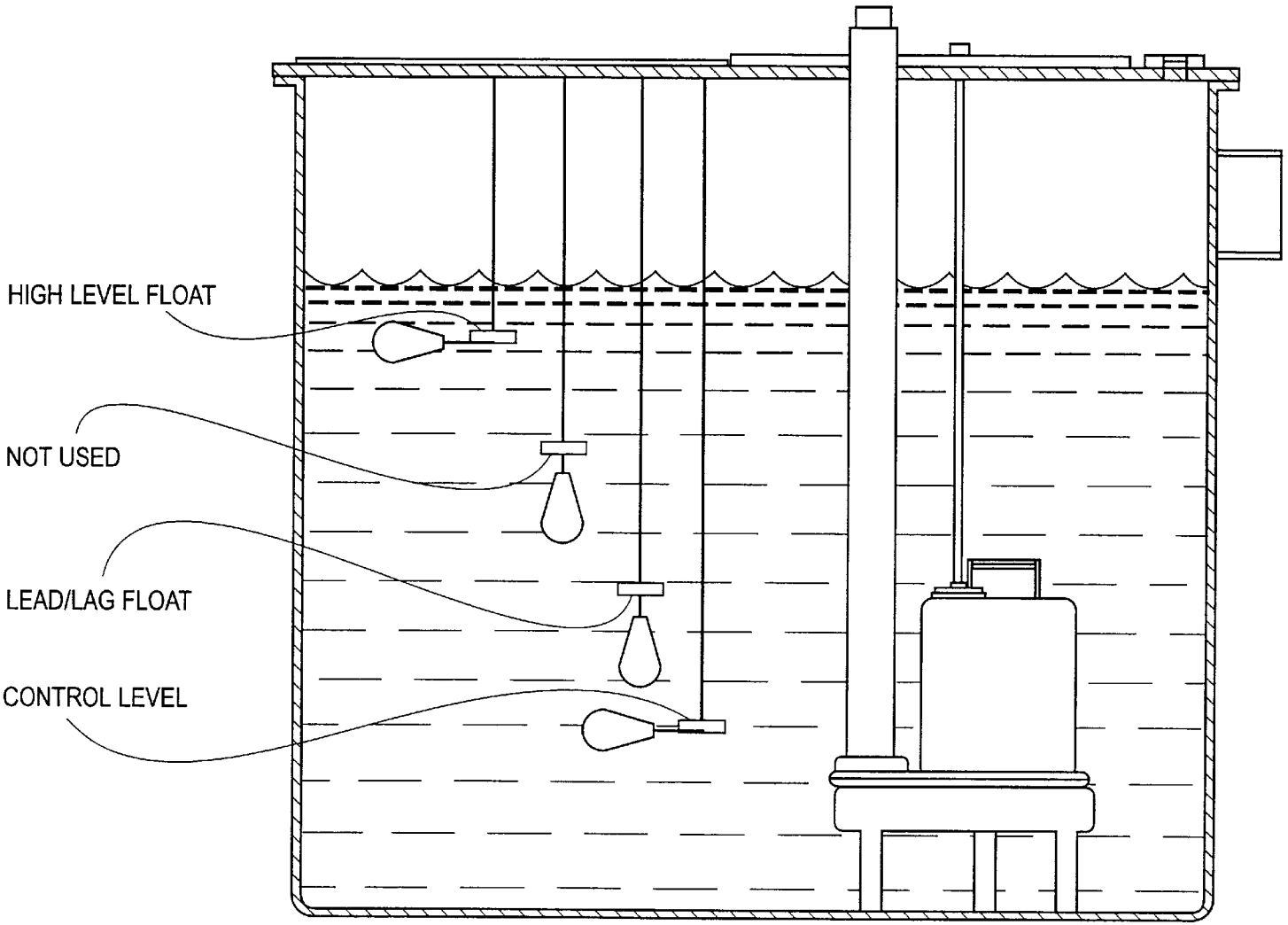
Figure 28:
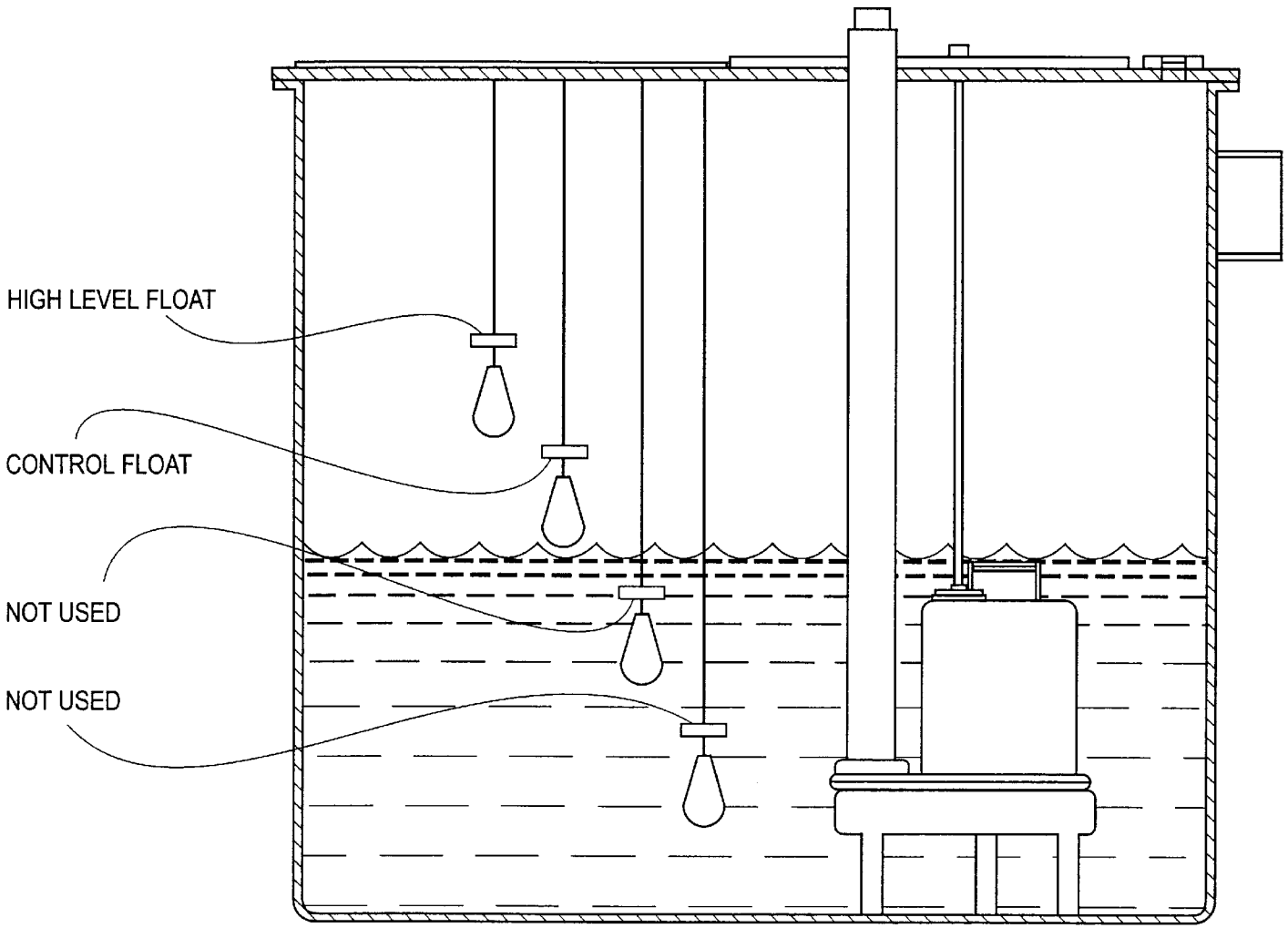
Figure 29:
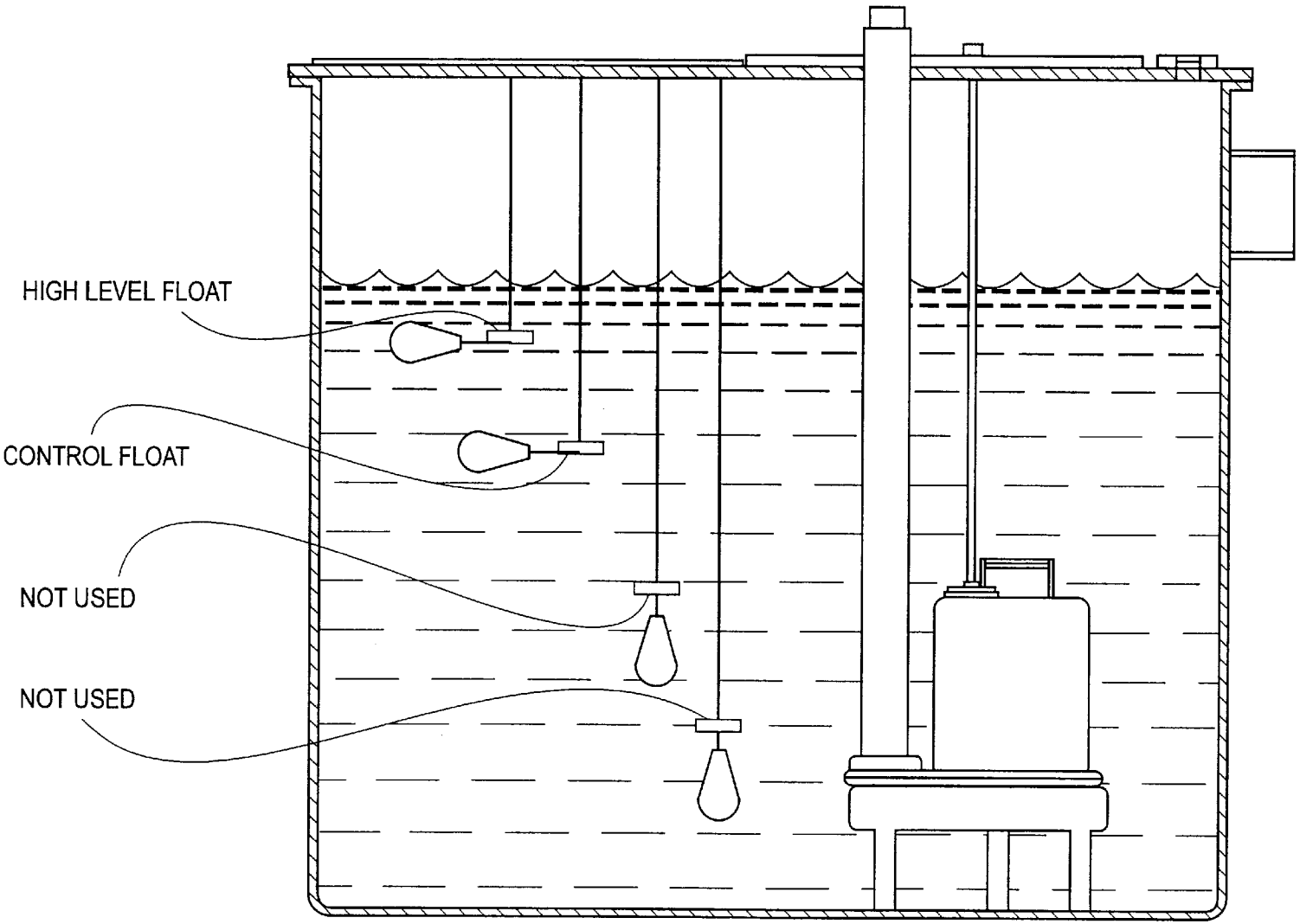
Figure 30:
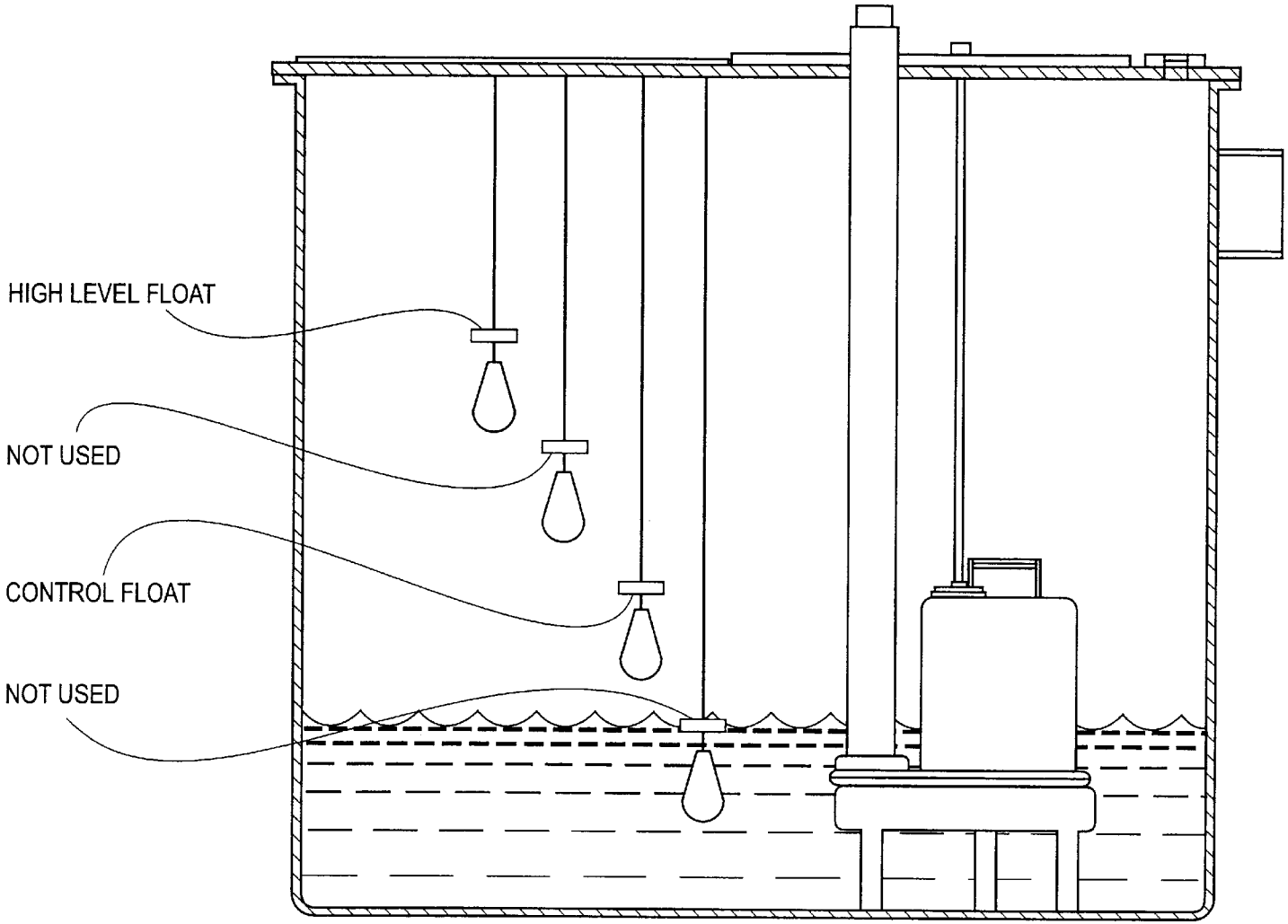
Figure 31:
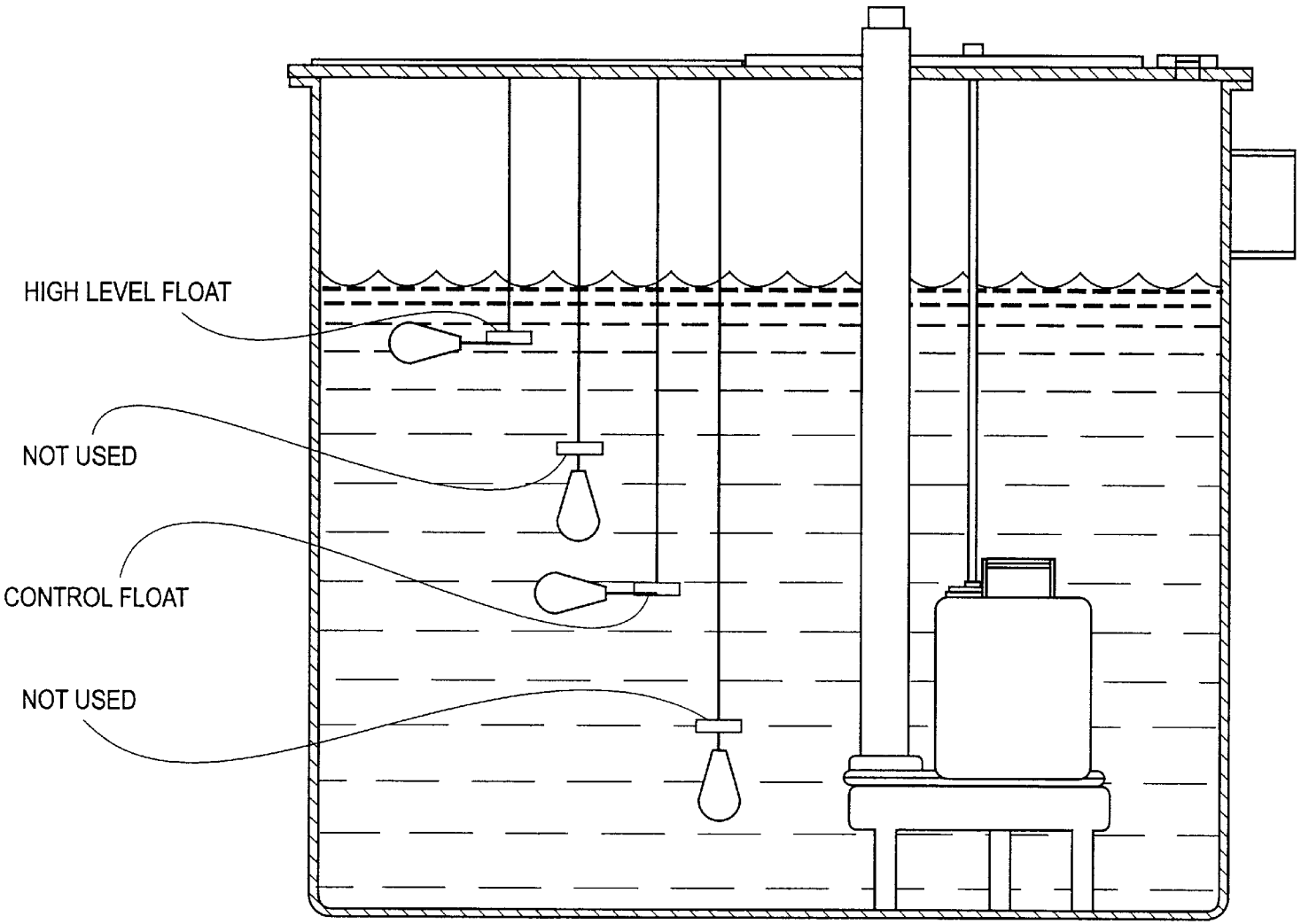
Figure 32:
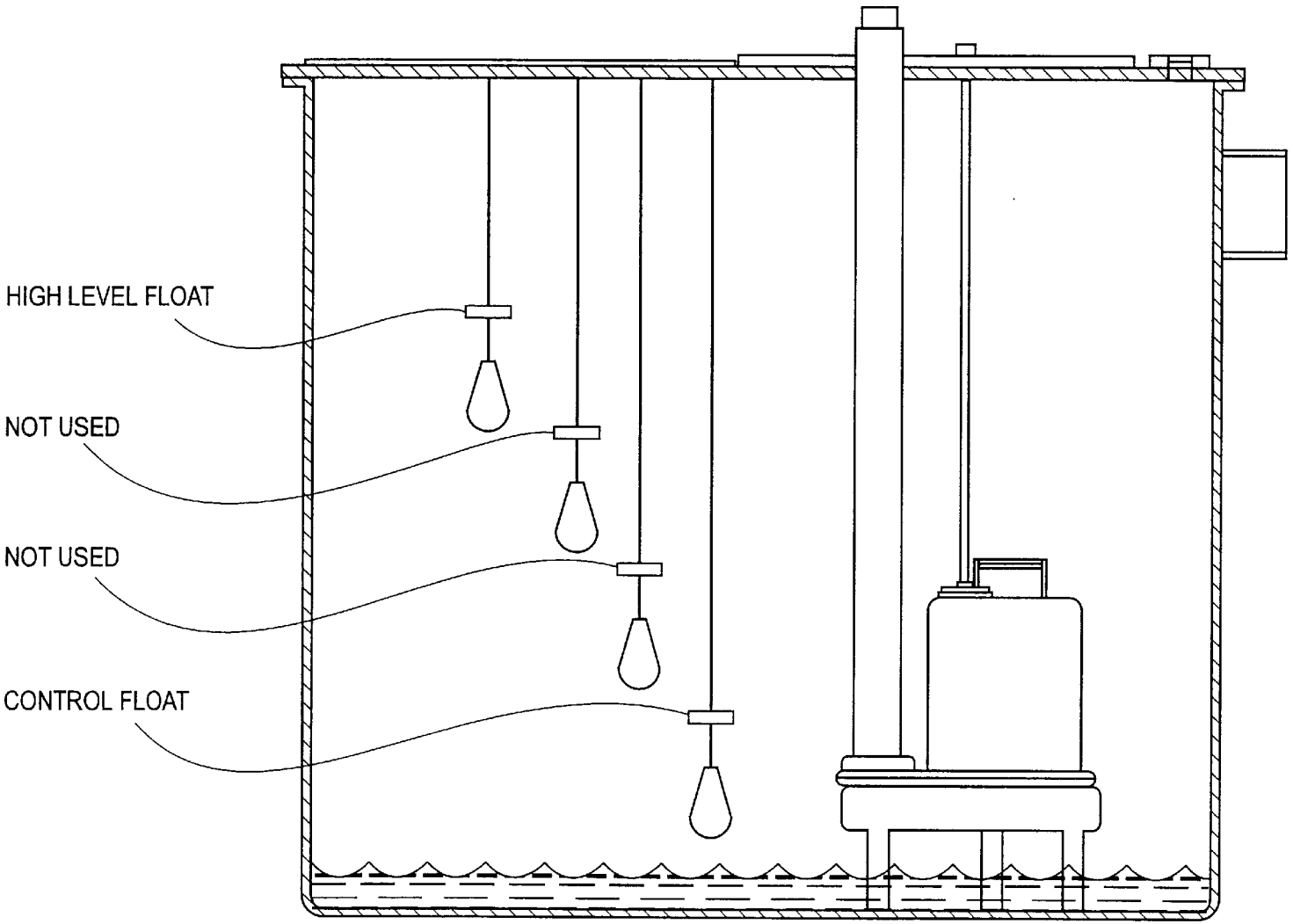
Figure 33:
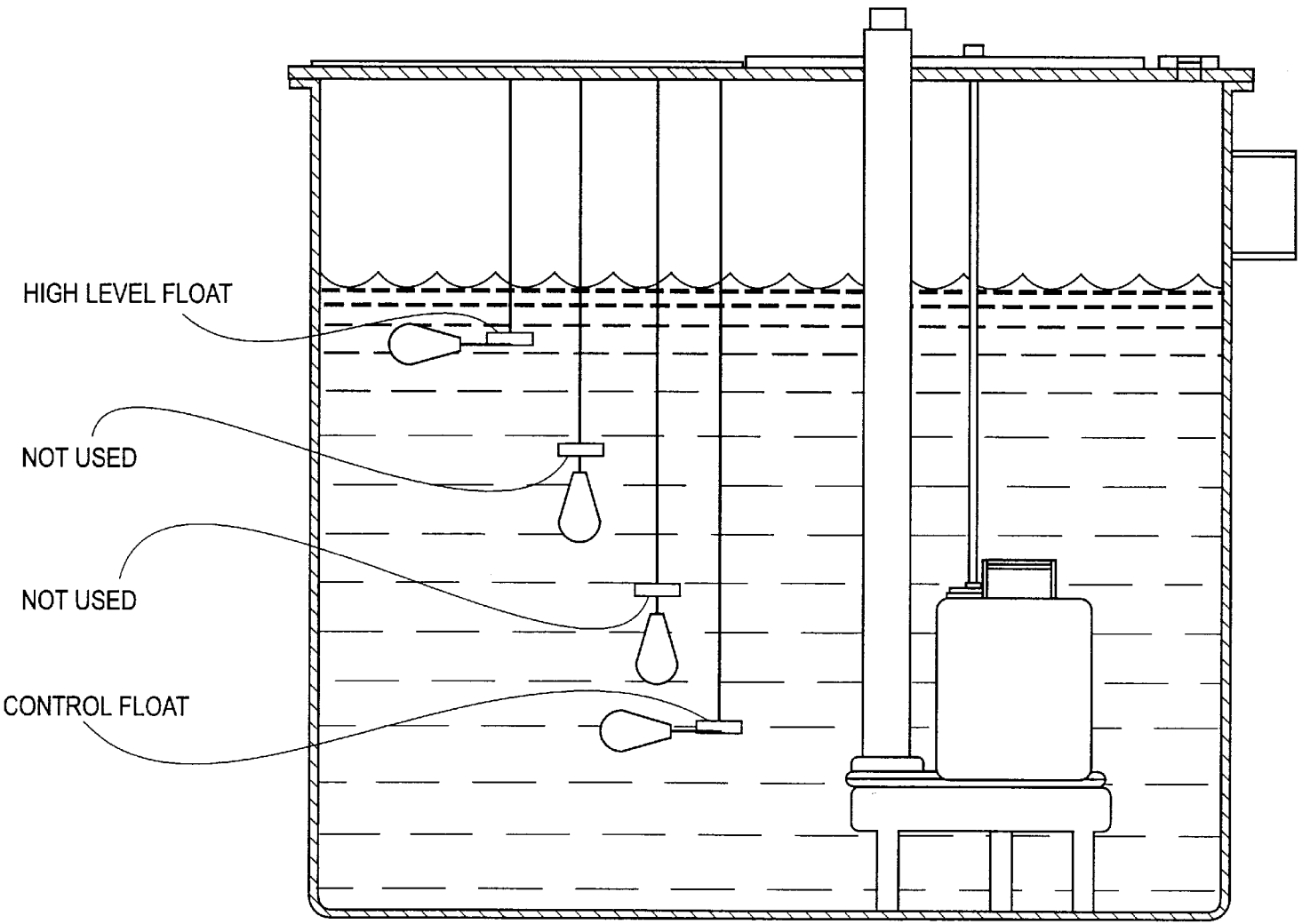
Figure 34:
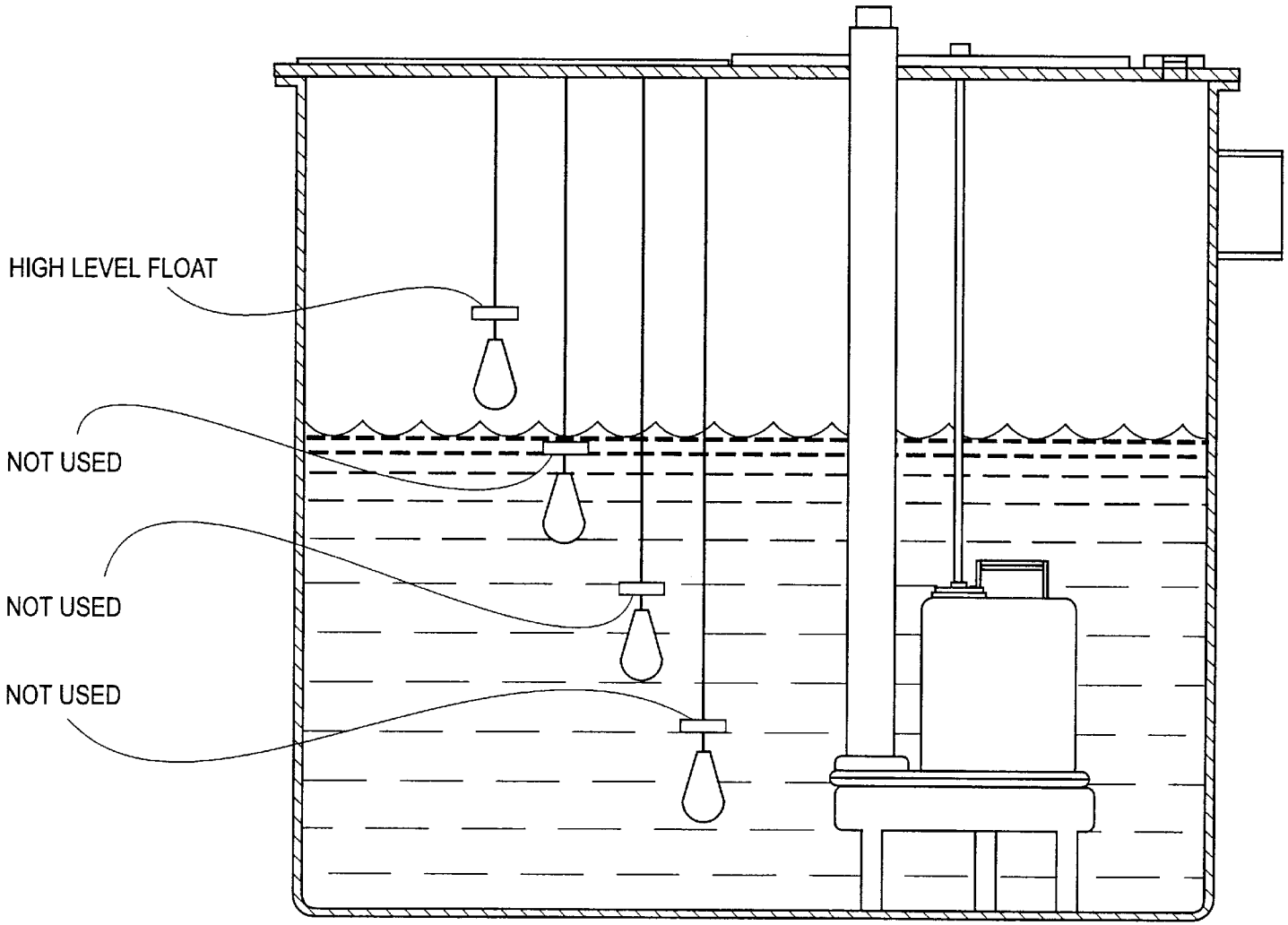
Figure 35:
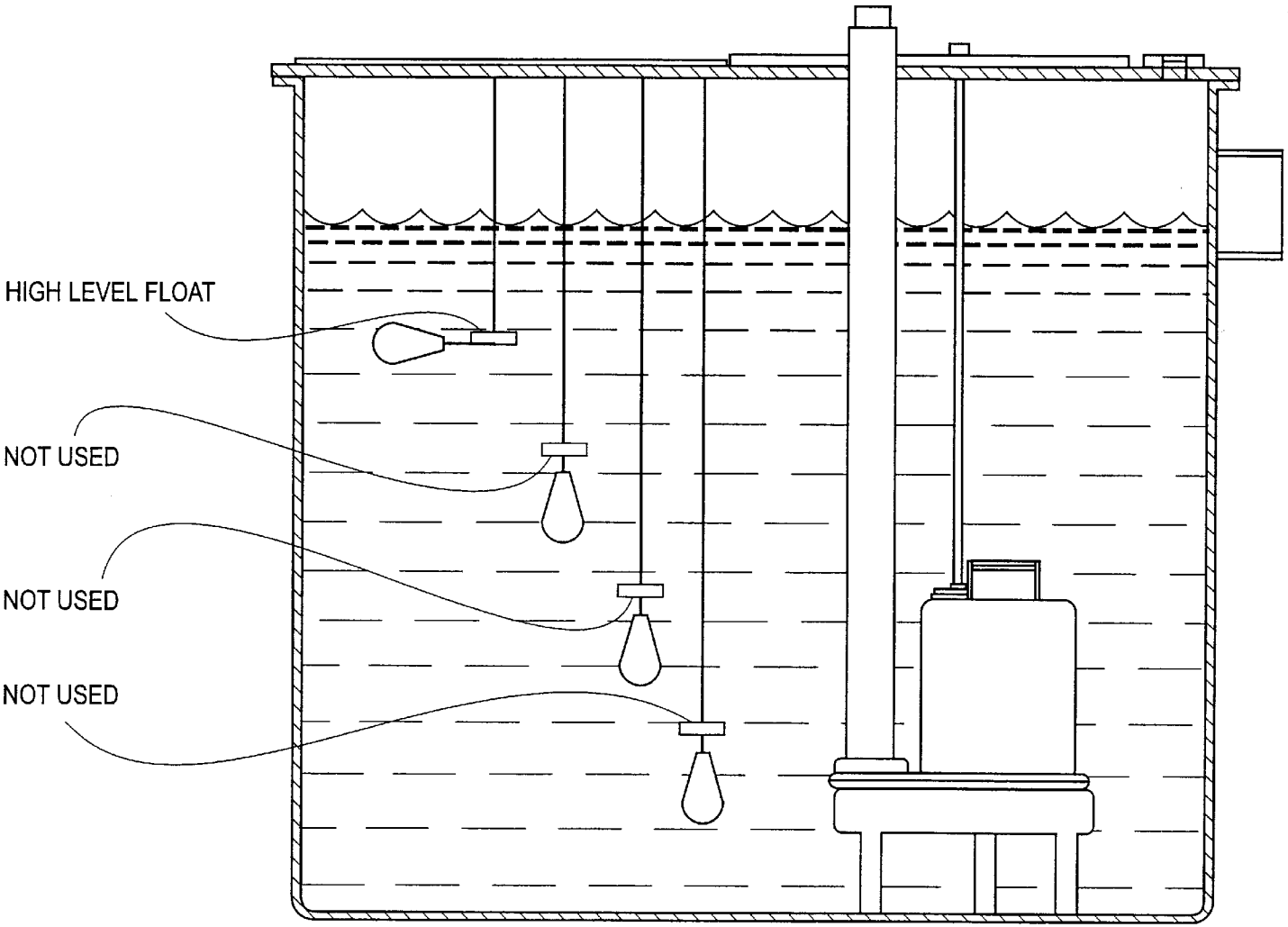

FIG. 1*b* illustrates a tank T wherein system 10 is to control a fluid level L. As illustrated in FIG. 1, feedback signals, FB1, FB2 . . . FBn are produced by fluid level feedback switches SW-1 . . . SWn whose outputs correspond to the respective signals FB1 . . . FBn. Feedback switches SW-1 . . . SW-n can be implemented as float switches, pressure switches or the like without limitation. Also located within the tank T is a plurality of pumps P1 . . . Pm.

As described subsequently, processor 14 in response to feedback signals receive via connector 20*b* allocates and reallocates functions assigned to various of the switches SW-1 . . . SW-n depending on the performance thereof. Additionally, processor 14 generates pump drive signals communicated by connector 22*b* to the pumps P1 . . . Pm in the tank T.

Operation of the software of the system 10 under varying circumstances is best illustrated by the following examples. In the following examples, four feedback signals FB1, 2, 3 and 4 are available from four different floats whose functions of control, lead, lag and high-level indicator can be assigned and re-assigned by processor 14. For exemplary purposes the following examples utilize two pumps P1, PP2 for purposes of controlling the level L in the tank T.

I. OPERATING MODES

The system 10 runs in two basic modes:

1. Non-Error Mode and
2. Error Mode

A. Non-Error Mode

The Non-Error Mode is a software environment operating on the assumption that the four floats in the system F1, F2, F3, F4 are functioning properly and are ALWAYS VALID. If the four floats operate according to specified sequences without ever straying from those specified sequences then there is no error. If no out-of-sequence events occur while in the Non-Error Mode then the floats are designated ALWAYS VALID.

There are several 'sequences' which the floats can follow while in the Non-Error Mode. It is the states of the floats F1 . . . F4 which account for whether or not system 10 is operating properly or improperly. The following discussion, relative to FIGS. 2–35, is of a system having two pumps P1, P2. Pump P1 is illustrated. Pump P2 is located behind P1 in the figures. It will be understood that the system 10 could be used to control a plurality of pumps without limitation. The following is a sequence list which constitutes the Non-Error Mode.

Sequence #1: All four of the valid floats are OFF.

If the system 10 is operating in this sequence then both the Lead pumps and the Lag pump P2 are turned off. This assumes that the water level in the tank is below the Control float. (See FIG. 2)

Sequence #2: The Lead and Lag floats are ON while the Control float is OFF.

If the system 10 should enter into this sequence the processor 14 will assume the Control float F1 is inoperable and disable it. Disabling Float 1 automatically enables the Error Mode environment thereby exiting the Non-Error Mode. Further processing is performed within the Error Mode #1 environment. (See FIG. 3)

Sequence #3: The Control and Lag Floats are ON while the Lead float is OFF.

If the system 10 should enter into this sequence the processor 14 will assume the Lead float F2 is inoperable and disable it. Disabling Float P2 automatically enables the Error Mode environment thereby exiting the Non-Error Mode. Further processing is performed within the Error Mode #2 environment. (See FIG. 4)

Sequence #4: The Control, Lead, and High floats are ON while the Lag float is OFF.

If the system 10 should enter into this sequence the processor 14 will assume the Lag float F3 is inoperable and disable it. Disabling Float 3 automatically enables the Error Mode environment thereby exiting the Non-Error Mode. Further processing is performed within the Error Mode #3 environment. (See FIG. 5)

Sequence #5: The Lag and High floats are ON while the Control and Lead floats are OFF.

If the system 10 should enter into this sequence the processor 14 will assume the Control and Lead floats F1, F2 are inoperable and disable them. Disabling Float 1 and Float F2 will automatically enable the Error Mode environment thereby exiting the Non-Error Mode. Further processing is performed within the Error Mode #4 environment. (See FIG. 6)

Sequence #6: The Lead and High floats are ON while the Control and Lag floats are OFF.

If the system 10 should enter into this sequence the processor 14 will assume the Control and Lag floats F1, F3 are inoperable and disable them. Disabling Float 1 and Float 3 will automatically enable the Error Mode environment thereby exiting the Non-Error Mode. Further processing is performed within the Error Mode #5 environment. (See FIG. 7)

Sequence #7: The Control and High floats are ON while the Lead and Lag floats are OFF.

If the system 10 should enter into this sequence the processor 14 will assume the Lead and Lag floats F2 are inoperable and disable them. Disabling Float F2 and Float 3 will automatically enable the Error Mode environment thereby exiting the Non-Error Mode. Further processing is performed within the Error Mode #6 environment. (See FIG. 8)

Sequence #8: The Control, Lead, and Lag floats are OFF while the High float is ON.

If the system 10 should enter into this sequence the processor 14 will assume the Control, Lead, and Lag floats F1, F2, F3 are inoperable and disable them. We must assume the High Level float F4 is ALWAYS VALID. Disabling Float 1, Float 2, and Float 3 will automatically enable the Error Mode environment thereby exiting the Non-Error Mode. Further processing is performed within the Error Mode #7 environment. (See FIG. 9)

Sequence #9: The Control and Lead floats are ON while the Lag and High floats are OFF.

If the system 10 should enter into this sequence the Lead pump P1 will be enabled. This assumes water level has risen above the Control float and Lead float but has not yet reached the Lag float or High level float. Since this is a natural sequence we remain in the Non-Error Mode and continue scanning through the sequence list. (See FIG. 10)

Sequence #10: All four of the valid floats are ON.

If the system 10 should enter into this sequence the Lead and Lag pump P1, P2 will be enabled along with a High Level Alarm. This assumes the water level L has risen near the top of the tank and activated all of the floats. Since this is a normal sequence we remain in the Non-Error Mode and continue scanning through the sequence list. (See FIG. 11)

Sequence #11: The Control, Lead, and Lag floats are ON while the High float is OFF.

If the system 10 should enter into this sequence the Lead and Lag pump P1, P2 will be enabled. This assumes the water level L has risen enough to activate the first three floats but not high enough to activate the High level float F4. Since this is a normal sequence we remain in the Non-Error Mode and continue scanning through the sequence list. (See FIG. 12). At this point the process returns to Sequence 1, above.

B. Error Mode

The Error Mode is a software environment which is initiated when there is an out-of-sequence event. When the processor 14 recognizes such a fault it "remembers" which float or floats were involved and invokes the Error Mode environment.

During error mode operation the processor 14 is constantly monitoring float activity for the possibility of further errors OR the possibility that the once faulted float(s) have now regained operation. Like the Non-Error Mode, the Error Mode too has many different sequences.

Depending on what circumstance caused entry into the error mode, each error mode sequence is tailored around THAT entry sequence. The following is a list of Error Mode sequences and their specific operations.

Error Mode #1

If the system 10 is operating in this mode then Float #1 is no longer valid. The remaining three floats are now reassigned specific priorities:

| WAS | | NOW | |
|---|---|---|---|
| Float #1 | Control Float | Float #1 | Not Used |
| Float #2 | Lead Float | Float #2 | Control Float |
| Float #3 | Lag Float | Float #3 | Lead Float & Lag Float |
| Float #4 | High Level Float | Float #4 | High Level Float |

Sequence #1: All three of the valid floats are OFF.

If the system 10 is operating in this sequence then both the Lead pump P1 and the Lag pump P2 are turned off. This assumes the water level L in the tank T is above Float #1 but below Float #2. (See FIG. 13)

Sequence #2: The Control, Lead, and Lag Floats are ON. (i.e. Float #P2 and Float #3 are ON.)

If the system 10 should enter into this sequence then both the Lead and Lag pumps P1, P2 will be enabled. This implies the water level L has risen high enough to activate Float #2 and Float #3 but not high enough to activate the High Level Float F4. Since this is a normal occurrence no further errors are logged by the processor. (See FIG. 14)

Sequence #3: The High Level Float is ON (i.e. Float #4 is ON.)

If the system 10 should enter into this sequence then both the Lead and Lag pumps P1, P2 will be enabled. This implies the water level L has risen to some maximium determined limit. Since this is a normal occurrence no further errors are logged by the processor. Sequence #3 is used as a backup sequence to ensure pump activation if the water level has risen to the maximum limit. (See FIG. 15)

Sequence #4: The Lead, Lag, and High Level Float is ON while the Control Float is OFF. (i.e. Float #3 and Float #4 are ON while Float #2 is OFF.)

If the system 10 should enter into this sequence the processor 14 will assume Float #2 is inoperable and disable it. At this point Float #1 and Float #2 are both inoperable thereby disabling Error Mode #1. Further processing is performed within Error Mode #4 (Float #1 and Float #2 invalid). (See FIG. 16)

Sequence #5: The Control and High Level Floats are ON while the Lead and Lag Float is OFF. (i.e. Float #2 and Float #4 are ON while Float #3 is OFF.)

If the system 10 should enter into this sequence the processor 14 will assume Float #3 is inoperable and disable it. At this point Float #1 and Float #3 are both inoperable thereby disabling Error Mode #1. Further processing is performed within Error Mode #5 (Float #1 and Float #3 invalid). (See FIG. 17)

Float #1 Test. At this point we look to see if Float #1 has regained use. If we have a valid float signal the processor will reactivate Float #1. Assuming no other floats have faulted the processor exits the Error Mode Environment and enters the Non-Error Mode Environment. At this point system 10 returns to Error Mode #1, Sequence #1.

If the system 10 is operating in this mode then Float #2 is no longer valid. The remaining three floats are now reassigned specific priorities:

| WAS | | NOW | |
|---|---|---|---|
| Float #1 | Control Float | Float #1 | Control Float |
| Float #2 | Lead Float | Float #2 | Not Used |
| Float #3 | Lag Float | Float #3 | Lead Float & Lag Float |
| Float #4 | High Level Float | Float #4 | High Level Float |

Sequence #1: All three of the valid floats are OFF.

If the system 10 is operating in this sequence then both the Lead pump P1 and the Lag pump P2 are turned off. This assumes the water level L in the tank T is below Float #1. (See FIG. 18)

Sequence #2: The Control, Lead, and Lag Floats are ON. (i.e. Float #1 and Float #3 are ON.)

If the system 10 should enter into this sequence L the both the Lead and Lag pumps P1, P2 will be enabled. This implies the water level L has risen high enough to activate Float #1 and Float #3 but not high enough to activate the High Level Float F4. Since this is a normal occurrence no further errors are logged by the processor. (See FIG. 19)

Sequence #3: The High Level Float is ON (i.e. Float #4 is ON.)

If the system 10 should enter into this sequence the both the Lead and Lag pumps P1, P2 will be enabled. This implies the water level L has risen to some maximum determined limit. Since this is a normal occurrence no further errors are logged by the processor 14. Sequence #3 is used as a backup sequence to ensure pump activation if the water level L has risen to the maximum limit. (See FIG. 20)

Sequence #4: The Lead, Lag, and High Level Float is ON while the Control Float is OFF (i.e. Float #3 and Float #4 are ON while Float #1 is OFF.)

If the system 10 should enter into this sequence the processor 14 will assume Float #1 is inoperable and disable it. At this point Float #1 and Float #2 are both inoperable thereby disabling Error Mode #2. Further processing is performed within Error Mode #4 (Float #1 and Float #2 invalid). (See FIG. 21)

Sequence #5: The Control and High Level Floats are ON while the Lead and Lag Float is OFF. (i.e. Float #1 and Float #4 are ON while Float #3 is OFF.)

If the system 10 should enter into this sequence the processor 14 will assume Float #3 is inoperable and disable it. At this point Float #2 and Float #3 are both inoperable thereby disabling Error Mode #2. Further processing is performed within Error Mode #6 (Float #P2 and Float #3 invalid). (See FIG. 22)

Float #2 Test. At this point we look to see if Float #2 has regained use. If we have a valid float signal the processor will reactivate Float #2. Assuming no other floats have faulted the processor exits the Error Mode Environment and enters the Non-Error Mode Environment. At this point system 10 returns to Error Mode #2, Sequence #1.

Error Mode #3

If the system 10 is operating in this mode then Float #3 is no longer valid. The remaining three floats are now reassigned specific priorities:

| WAS | | NOW | |
|---|---|---|---|
| Float #1 | Control Float | Float #1 | Control Float |
| Float #2 | Lead Float | Float #2 | Lead Float & Lag Float |
| Float #3 | Lag Float | Float #3 | Not Used |
| Float #3 | High Level Float | Float #4 | High Level Float |

Sequence #1: All three of the valid floats are OFF.

If the system 10 is operating in this sequence then both the Lead pump P1 and the Lag pump P2 are turned off. This assumes the water level L in the tank T is below Float #1. (See FIG. 23)

Sequence #2: The Control, Lead, and Lag Floats are ON (i.e. Float #1 and Float #2 are ON.)

If the system 10 should enter into this sequence then both the Lead and Lag pumps P1, P2 will be enabled. This implies the water level L has risen high enough to activate Float #1 and Float #2 but not high enough to activate the High Level Float F4. Since this is a normal occurrence no further errors are logged by the processor. (See FIG. 24)

Sequence #3: The High Level Float is ON (i.e. Float #4 is ON.)

If the system 10 should enter into this sequence then both the Lead and Lag pumps P1, P2 will be enabled. This implies the water level L has risen to some maximum determined limit. Since this is natural occurrence no further errors are logged by the processor 14. Sequence #3 is used as a backup sequence to ensure pump activation if the water level has risen to the maximum limit. (See FIG. 25)

Sequence #4: The Lead, Lag, and High Level Float are ON while the Control Float is Off (i.e. Float #2 and Float #4 are ON while Float #1 is OFF.)

If the system 10 should enter into this sequence the processor 14 will assume Float #1 is inoperable and disable it. At this point Float #1 and Float #3 are both inoperable thereby disabling Error Mode #3. Further processing is performed within Error Mode #5 (Float #1 and Float #2 invalid). (See FIG. 26)

Sequence #5: The Control and High Level Floats are ON while the Lead and Lag Float is OFF. (i.e. Float #1 and Float #4 are ON while Float #2 is OFF.)

If the system 10 should enter into this sequence the processor 14 will assume Float #2 is inoperable and disable it. At this point Float #2 and Float #3 are both inoperable thereby disabling Error Mode #3. Further processing is performed within Error Mode #6 (Float #2 and Float #3 invalid). (See FIG. 27)

Float #3 Test. At this point we look to see if Float #3 has regained use. If we have a valid float signal the processor will reactivate Float #3. Assuming no other floats have faulted the processor exits the Error Mode Environment and enters the Non-Error Mode Environment. The system 10 then returns to Error Mode #3, Sequence #1.

Error Mode #4:

If the system 10 is operating in this mode then Float #1 and Float #2 are no longer valid. The two remaining floats are now reassigned specific priorities:

| WAS | | NOW | |
|---|---|---|---|
| Float #1 | Control Float | Float #1 | Not Used |
| Float #2 | Lead Float | Float #2 | Not Used |
| Float #3 | Lag Float | Float #3 | Control Float |
| Float #4 | High Level Float | Float #4 | High Level Float |

Sequence #1: Both of the valid floats are OFF.

If the system 10 is operating in this sequence then both the Lead pump P1 and the Lag pump P2 are turned off. This assumes that the water level L in the tank T is below the Control float F1. (See FIG. 28)

Sequence #2: The Control and High Level floats are ON.

If the system 10 is operating in this sequence then both the Lead and Lag pumps P1, P2 will be enabled. No further faults are able to be detected reliably from this point therefore Float #3 and Float #4 remain continuously valid. (See FIG. 29)

Float Test. At this point we look to see if Float #1 has regained use. If we have a valid float signal the processor will reactivate Float #1. Doing this will disable error Mode #4 and enable Error Mode #2 (Float #2 invalid). If Float #1 is invalid the processor checks to see whether Float #2 has regained use. If we have a valid Float signal the processor will reactivate Float #2. Doing this will disable Error Mode #4 and enable Error Mode #1 (Float #1 invalid) if Float #2 is invalid system 10 returns to Error Mode #4, Sequence #1. System 10 then returns to Error Mode #4, Sequence #1.

Error Mode #5:

If the system 10 is operating in this mode then Float #1 and Float #3 are no longer valid, The two remaining floats are now reassigned specific priorities:

| WAS | | NOW | |
|---|---|---|---|
| Float #1 | Control Float | Float #1 | Not Used |
| Float #2 | Lead Float | Float #2 | Control Float |
| Float #3 | Lag Float | Float #3 | Not Used |
| Float #4 | High Level Float | Float #4 | High Level Float |

Sequence #1: Both of the valid floats are OFF.

If the system 10 is operating in this sequence then both the Lead pump P1 and the Lag pump P2 are turned off. This assumes that the water level L in the tank T is below the Control float F1. (See FIG. 30)

Sequence #2: The Control and High Level floats are ON.

If the system 10 is operating in this sequence then both the Lead and Lag pumps P1, P2 will be enabled. No further faults are able to be detected reliably from this point therefore Float #2 and Float #4 remain continuously valid. (See FIG. 31)

Float Test. At this point we look to see if Float #1 has regained use. If we have a valid float signal the processor will reactivate Float #1. Doing this will disable error Mode #5 and enable Error Mode #3 (Float #3 invalid). If Float #1 is invalid the processor checks to see whether Float #3 has regained use. If we have a valid Float signal the processor will reactivate Float #3. Doing this will disable Error Mode #5 and enable Error Mode #1 (Float #1 invalid). If Float #3 is invalid system 10 returns to Error Mode #5, sequence #1.

Error Mode #6

If the system 10 is operating in this mode then Float #2 and Float #3 are no longer valid, The two remaining floats are now reassigned specific priorities:

| WAS | | NOW | |
|---|---|---|---|
| Float #1 | Control Float | Float #1 | Control Float |
| Float #2 | Lead Float | Float #2 | Not Used |
| Float #3 | Lag Float | Float #3 | Not Used |
| Float #4 | High Level Float | Float #4 | High Level Float |

Sequence #1: All two of the valid floats are OFF.

If the system 10 is operating in this sequence then both the Lead pump P1 and the Lag pump P1 are turned off. This assumes that the water level L in the tank T is below the Control float F1. (See FIG. 32)

Sequence #2: The Control and High Level floats are ON.

If the system 10 is operating in this sequence then both the Lead and Lag pumps P1, P2 will be enabled. No further faults are able to be detected reliably from this point therefore Float #1 and Float #4 remain continuously valid. (See FIG. 33)

Float Test. At this point we look to see if Float #2 has regained use. If we have a valid float signal the processor will reactivate Float #2. Doing this will disable error Mode #6 and enable Error Mode #3 (Float #3 invalid). If Float #2 is invalid the processor checks to see whether Float #3 has regained use. If we have a valid Float signal the processor will reactivate Float #3. Doing this will disable Error Mode #6 and enable Error Mode #2 (Float #2 invalid). If Float #3 is invalid system 10 returns to Error Mode 6, Sequence #1.

Error Mode #7

If the system 10 is operating in this mode then Float #1, Float #2, and Float #3 are no longer valid. The system is forced to run off of the High Level Float (Float #4).

| WAS | | NOW | |
|---|---|---|---|
| Float #1 | Control Float | Float #1 | Not Used |
| Float #2 | Lead Float | Float #2 | Not Used |
| Float #3 | Lag Float | Float #3 | Not Used |
| Float #4 | High Level Float | Float #4 | High Level Float |

Sequence #1: High Level Float is OFF.

If the system 10 is operating in this sequence (and the 6 minute short cycle timer has expired) then both the Lead pump P1 and the Lag pump P2 are turned off. This assumes the water level in the tank is below Float #4. (See FIG. 34)

Sequence #2: High Level Float is ON.

If the system 10 is operating in this sequence then both the Lead and Lag pumps P1, P2 will be enabled. Entering this sequence enables a 6 minute timer which prohibits short cycling of the pump motors if the High Level Float F4 rapidly changes states. (See FIG. 35)

Float Test. At this point we look to see if Float #1 has regained use. If we have a valid float signal the processor will reactivate Float #1. Doing this will disable error Mode #7 and enable Error Mode #6 (Float #2 and Float #3 invalid). If Float #1 is invalid the processor checks to see whether Float #2 has regained use. If we have a valid Float signal the processor will reactivate Float #2. Doing this will disable Error Mode #7 and enable Error Mode #5 (Float #1 and Float #3 invalid). If Float #2 is invalid the processor checks to see whether Float #3 has regained use. If we have a valid Float signal the processor will reactivate Float #3. Doing this will disable Error Mode #7 and enable Error Mode #4 (Float #1 and Float #2 invalid). If none of the floats are valid system 10 returns to Error Mode #7, Sequence #1.

Figure 36:
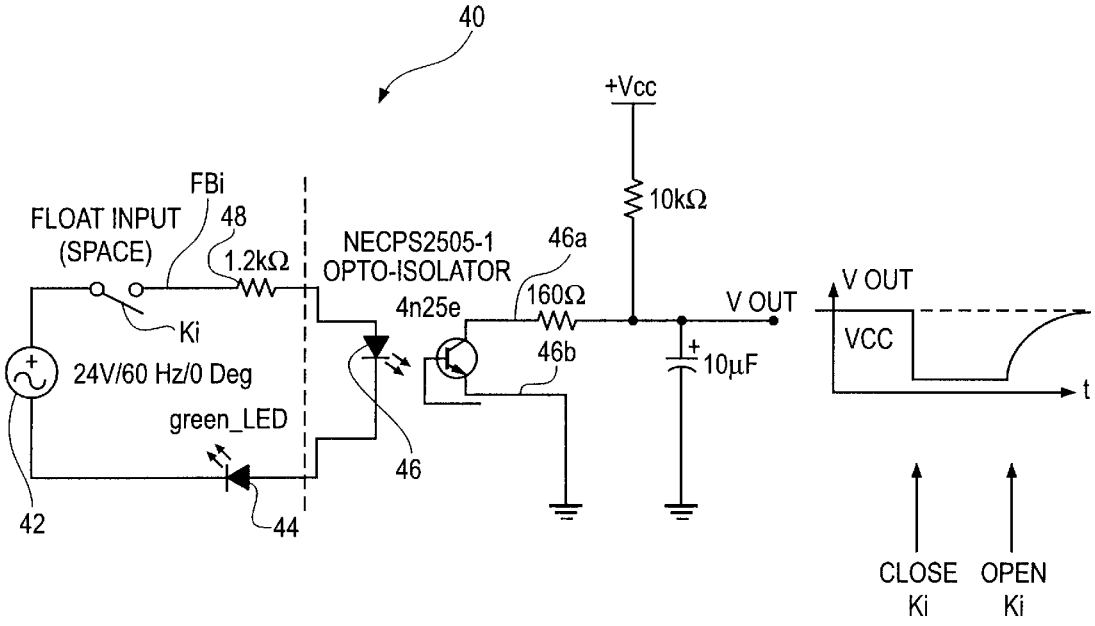
FIG. 36 is a schematic diagram of an exemplary float input circuit.

FIG. 36 is a schematic illustrating an exemplary float input interface circuit. In connection with the circuit 40 of FIG. 36, each float such as float Fi includes a level responsive switch such as SW-i, represented FIG. 36 as closable contact Ki. Circuit 40 includes a low voltage source of alternating current 42 coupled in series with a light emitting diode 44 an input side of an opto-isolator 46 and a current limiting resistor 48.

When the position of the respective float Fi causes the respective contact Ki to close a current with an appropriate will flow driving about half the cycle through light emitting diode 44 and opto-isolator 46. This will in turn cause the light emitting diode 44 to become illuminated. It will also cause photons to be emitted within the opto-isolator 46 whereupon a low impedance will be present between outputs 46*a,b* causing the output voltage Vout to drop close to zero volts.

So long as the contact Ki stays closed the output voltage Vout will stay low. When the position of the respective float changes and the contact Ki goes from a closed circuit to an open circuit state, a high output impedance will be present at line 46*a*. In this condition the output voltage Vout returns to VCC.

The output signal Vout can be coupled directly to processor 14. In a preferred embodiment contact Ki is closed, corresponding to a short circuited switch, when the fluid level associated with the respective float goes too high.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A pump control system comprising:

a processor;

preprogrammed instructions, executable by the processor, for automatically controlling, on a real-time basis at least first and second pumps in response to at least two different fluid inputs from a common fluid supply;

feedback circuitry for monitoring operation of the pumps, and simultaneous inputs from at least four fluid level related switches wherein the instructions automatically reallocate at least one input function in response to a sensed failure of at least one of the switches.

2. A system as in claim 1 wherein the instructions reallocate up to two input functions among two remaining inputs in response to a sensed failure of at least two of the switches.

3. A system as in claim 1 which includes a communications port coupled to the processor.

4. A method of providing a degree of fail safe fluid control comprising:

providing at least first, second and third level inputs from a common fluid source wherein each of the second and third inputs correspond to successively increasing, different fluid levels which exceed the level associated with the first input; and allocating, initially first, second and third control functions to respective ones of the inputs;

detecting, in real-time, a failure of one of the inputs and, in response thereto, automatically reallocating the function assigned thereto to one of the other inputs.

5. A method as in claim 4 including generating pump activating output for each member of a plurality of pumps in response to the input signals.

6. A method as in claim 5 which includes monitoring the performance of the pumps.

7. A method as in claim 5 which includes allocating a lead pump function, on a rotating basis, to various of the pumps.

8. A method as in claim 5 which includes establishing a plurality of input dependent states, on an interrupt driven basis for carrying out the reallocating step.

* * * * *